US010184286B2

(12) United States Patent
Kennedy et al.

(10) Patent No.: US 10,184,286 B2
(45) Date of Patent: Jan. 22, 2019

(54) ARTICULATED MINE DOOR OPENING MECHANISM

(71) Applicant: Jack Kennedy Metal Products & Buildings, Inc., Taylorville, IL (US)

(72) Inventors: William R. Kennedy, Taylorville, IL (US); John M. Kennedy, Taylorville, IL (US)

(73) Assignee: Jack Kennedy Metal Products & Buildings, Inc., Taylorville, IL (US)

( * ) Notice: Subject to any disclaimer, the term of this patent is extended or adjusted under 35 U.S.C. 154(b) by 83 days.

(21) Appl. No.: 15/343,979

(22) Filed: Nov. 4, 2016

(65) Prior Publication Data

US 2017/0130506 A1 May 11, 2017

Related U.S. Application Data

(60) Provisional application No. 62/252,119, filed on Nov. 6, 2015.

(51) Int. Cl.

| | |
|---|---|
| ***E05F 15/616*** | (2015.01) |
| ***E21F 1/12*** | (2006.01) |
| ***E05F 15/63*** | (2015.01) |
| ***E21F 1/10*** | (2006.01) |
| *E06B 3/36* | (2006.01) |

(52) U.S. Cl.

CPC ..... *E05F 15/616* (2015.01); *E05F 15/63* (2015.01); *E21F 1/10* (2013.01); *E21F 1/12* (2013.01); *E05Y 2201/624* (2013.01); *E05Y 2900/60* (2013.01); *E06B 3/36* (2013.01)

(58) Field of Classification Search

CPC ..... E05F 15/63; E05F 15/616; E05F 15/611; E05F 15/614; E05F 15/627; E21F 1/10; E21F 1/12; E06B 3/36; E05Y 2201/624

See application file for complete search history.

(56) References Cited

U.S. PATENT DOCUMENTS

| | | | |
|---|---|---|---|
| 584,809 | A | 6/1897 | Anthony |
| 988,622 | A | 4/1911 | Bowman |
| 1,291,910 | A | 1/1919 | Johnson |
| 1,318,349 | A | 10/1919 | Boos |
| 1,376,248 | A | 4/1921 | Boggio |
| 1,446,340 | A | 2/1923 | Ferguson |
| 1,510,600 | A | 10/1924 | Miller |
| 1,563,827 | A | 12/1925 | Boggio |

(Continued)

OTHER PUBLICATIONS

Articulate—Define the American Heritage® Dictionary of the English Language, Fourth Edition copyright © 2000 by Houghton Mifflin Company. Updated in 2009. Published by Houghton Mifflin Company. All rights reserved. http://www.thefreedictionary.com/articulate, 3 pgs.

(Continued)

*Primary Examiner* — Justin B Rephann

(74) *Attorney, Agent, or Firm* — Stinson Leonard Street LLP

(57) ABSTRACT

A mine door system which includes a mine door having a door leaf, and a door-moving mechanism that articulates between a first configuration in which the mechanism applies a relatively smaller door-moving force to the door leaf and moves it at a first speed and a second configuration in which the mechanism applies a larger door-moving force to the door leaf and moves it at a second speed less than the first speed.

30 Claims, 18 Drawing Sheets

(56) References Cited

U.S. PATENT DOCUMENTS

| | | | | |
|---|---|---|---|---|
| 1,620,669 | A | 3/1927 | Littlejohn | |
| 1,748,448 | A | 2/1930 | Gurney | |
| 1,903,384 | A | 4/1933 | Cooke | |
| 2,257,759 | A | 10/1941 | Niemann | |
| 2,924,449 | A | 2/1960 | Leimer et al. | |
| 3,654,873 | A | 4/1972 | Floehr | |
| 3,708,915 | A | 1/1973 | Davey | |
| 4,057,934 | A * | 11/1977 | Okubo | B66B 13/26 187/317 |
| 4,185,415 | A | 1/1980 | LaConte | |
| 4,231,190 | A * | 11/1980 | Tieben | E05F 15/627 49/25 |
| 4,522,321 | A | 6/1985 | Kinoshita | |
| 4,610,046 | A | 9/1986 | Buschur et al. | |
| 5,018,304 | A | 5/1991 | Longoria | |
| 5,040,331 | A | 8/1991 | Merendino et al. | |
| 5,394,651 | A * | 3/1995 | Vial | E05F 15/53 49/340 |
| 5,618,080 | A | 4/1997 | Sullivan et al. | |
| 5,752,344 | A | 5/1998 | Richmond | |
| 5,930,954 | A | 8/1999 | Hebda | |
| 6,067,753 | A | 5/2000 | Hebda | |
| 6,105,447 | A | 8/2000 | Linn | |
| 6,425,820 | B1 | 7/2002 | Kennedy et al. | |
| 6,766,616 | B2 | 7/2004 | Richter | |
| 6,883,275 | B2 | 4/2005 | Hellinga et al. | |
| 6,938,372 | B2 | 9/2005 | Kennedy et al. | |
| 6,955,594 | B2 | 10/2005 | Kennedy et al. | |
| 7,118,472 | B2 | 10/2006 | Kennedy et al. | |
| 7,293,819 | B2 | 11/2007 | Duffy | |
| 8,161,681 | B2 | 4/2012 | Treihaft | |
| 8,169,169 | B2 | 5/2012 | Hass et al. | |
| 8,341,889 | B2 | 1/2013 | Faulkner et al. | |
| 2002/0092237 | A1 | 7/2002 | Hebda | |
| 2004/0016180 | A1 | 1/2004 | Hellinga et al. | |
| 2004/0261319 | A1 | 12/2004 | Kennedy et al. | |
| 2004/0266329 | A1 | 12/2004 | Kennedy et al. | |
| 2009/0320375 | A1 | 12/2009 | Treihaft | |
| 2010/0162847 | A1 * | 7/2010 | Gassner | E05F 1/1058 74/490.07 |
| 2010/0223853 | A1 | 9/2010 | Daniel-Wayman et al. | |
| 2011/0203182 | A1 * | 8/2011 | Kennedy | E21F 1/12 49/333 |

OTHER PUBLICATIONS

Configuration—Define the American Heritage® Dictionary of the English Language, Fourth Edition copyright © 2000 by Houghton Mifflin Company. Updated in 2009. Published by Houghton Mifflin Company. All rights reserved http://www.thefreedictionary.com/Configuration, 3 pgs.

Four-bar analysis (Hebda, Spreadsheet, Clarence W. Mayott, PhD, May 10, 2012), 2 pgs.

* cited by examiner

ARTICULATED MINE DOOR OPENING MECHANISM

FIELD OF THE INVENTION

The present invention generally relates to mine ventilation equipment, and more particularly to a mechanism for opening a mine door.

BACKGROUND OF THE INVENTION

Mine doors are frequently used throughout a mine to control ventilation. The doors are typically large and heavy, and they are often opened and closed using hydraulic or pneumatic mechanisms. Examples of such mechanisms are described in U.S. Pat. Nos. 6,425,820, 6,938,372 and 7,118,472. While such mechanisms are generally reliable, they do have certain drawbacks, including complexity and expense. Also, since mine doors are very heavy and subject to large opening and closing pressures due to air flow in the mine, prior mechanisms are designed to move a mine door at slow speeds, which can waste valuable time. Further, the failure of a complex hydraulic or pneumatic mechanism may take substantial time to repair, which can severely impede operations in the mine.

There is a need, therefore, for an improved mine-door opening mechanism.

SUMMARY OF THE INVENTION

In one embodiment, a mine door system is provided comprising a mine door including a door leaf adapted to be hinged at one side to a door frame defining an entry. The mechanism also includes an articulated door-moving mechanism that articulates between a first configuration in which the mechanism applies a relatively smaller door-moving force to the door leaf and moves it at a first speed and a second configuration in which the mechanism applies a larger door-moving force to the door leaf and moves it at a second speed less than the first speed. The articulated door moving mechanism comprises a motor for driving pivoting movement of the door leaf, and a variable length crank drivingly connected to the motor so the motor can drive rotation of the variable length crank. The variable length crank has a first length when the articulated door-moving mechanism is in the first configuration and a second length different from the first length when the articulated door-moving mechanism is in the second configuration. An elongate compound link is provided comprising first and second rigid members secured together at a pivot connection for pivoting movement relative to one another about a pivot axis that is transverse to the longitudinal axis. The variable length crank is connected to the elongate compound link at a location on the first rigid member spaced from the pivot connection. The door leaf is connected to the second rigid member at an end of the second rigid member opposite the pivot connection. The first rigid member is shorter than the second rigid member.

In another embodiment, the mine door system comprises a mine door comprising a door leaf adapted to be hinged at one side to a door frame defining an entry. The door leaf comprises a panel. A draw bar extends from the panel and is adapted to move from a relatively more retracted position to a relatively more extended position relative to the panel. A biasing member is arranged to bias the draw bar toward the relatively more retracted position. An articulated door-moving mechanism articulates between a first configuration in which the mechanism applies a relatively smaller door-moving force to the door leaf and moves it at a first speed and a second configuration in which the mechanism applies a larger door-moving force to the door leaf and moves it at a second speed less than the first speed. The articulated door moving mechanism comprises a motor for driving pivoting movement of said door leaf, and a variable length crank drivingly connected to the motor so the motor can drive rotation of the variable length crank. The variable length crank comprises first and second crank arms connected to one another for pivoting movement relative to one another to change the length of the crank between a first relatively longer length and a second relatively shorter length, and a crank arm biasing member arranged to bias the first and second crank arms toward a configuration in which the variable length crank has the relatively longer length and to allow movement of the first and second crank arms against the bias to a configuration in which the variable length crank has the relatively shorter length. The variable length crank is connected to an elongate link at one end of the elongate crank, and the draw bar of the door leaf is connected to the elongate link at an opposite end of the elongate link. The system is designed so damping of the draw bar biasing member and damping of the crank arm biasing member substantially prevent any resonant dynamic interactions between the drawbar biasing member and the crank arm biasing member.

In another embodiment, the mine door system comprises a mine door comprising a door leaf adapted to be hinged at one side to a door frame defining an entry. The door leaf comprises a panel. A draw bar extends from the panel and is adapted to move from a relatively more retracted position to a relatively more extended position relative to the panel. A biasing member is arranged to bias the draw bar toward the relatively more retracted position. An articulated door-moving mechanism articulates between a first configuration in which the mechanism applies a relatively smaller door-moving force to the door leaf and moves it at a first speed and a second configuration in which the mechanism applies a larger door-moving force to the door leaf and moves it at a second speed less than the first speed. The articulated door moving mechanism comprises a motor for driving pivoting movement of the door leaf, and a variable length crank drivingly connected to the motor so the motor can drive rotation of the variable length crank. The variable length crank comprises first and second crank arms connected to one another for pivoting movement relative to one another to change the length of the crank between a first relatively longer length and a second relatively shorter length. A crank arm biasing member is arranged to bias the first and second crank arms toward a configuration in which the variable length crank has the relatively longer length and to allow movement of the first and second crank arms against the bias to a configuration in which the variable length crank has the relatively shorter length. The variable length crank is connected to an elongate link at one end of the elongate link, and the draw bar of the door leaf is connected to the elongate link at an opposite end of the elongate link. The draw bar biasing member and the crank arm biasing member each comprise a series of washers arranged to form a Bellville spring.

Other objects and features will be in part apparent and in part pointed out hereinafter.

BRIEF DESCRIPTION OF THE DRAWINGS

Corresponding reference characters indicate corresponding parts throughout the drawings.

DETAILED DESCRIPTION

Figure 1:
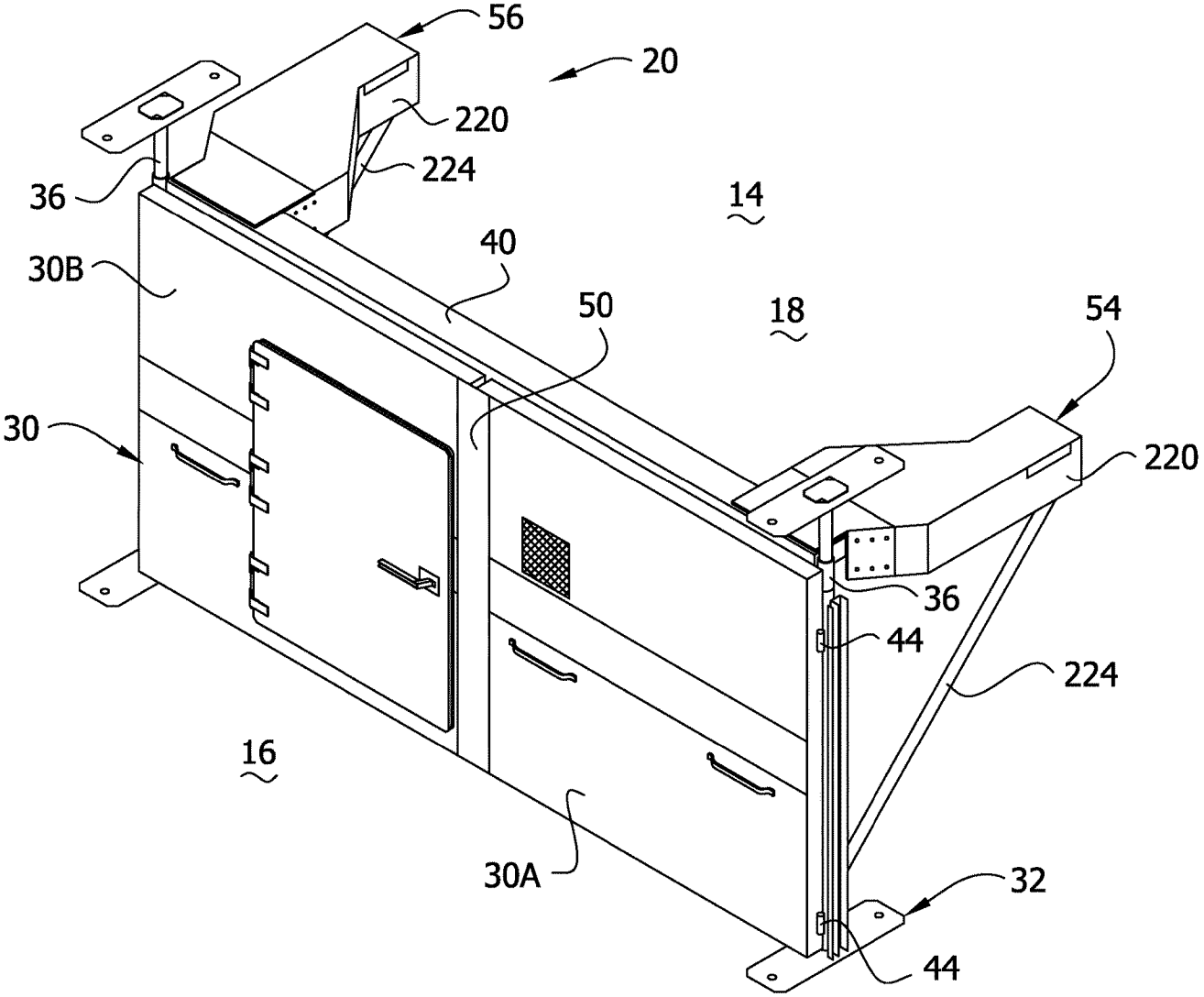
FIG. 1 is a perspective view of a mine door installation incorporating articulated door-moving mechanisms of this invention.

Referring now to the drawings, FIG. 1 illustrates one embodiment of a mine door system of this invention, generally designated 20. The system is adapted to be installed in a mine passageway 14 that has a high pressure zone 16 and a low pressure zone 18. In normal mine operation, the high pressure zone 16 (which is in fresh air) is on the side of the mine door system 20 most adjacent the mine entrance or in a passageway that during normal flow of air does not receive air that has passed along the mine face, and the low pressure zone 18 is the side of the mine door system 20 closest to the mine face where ore or mineral is being mined. However, the door system 20 can be placed in the return air of a mine (downstream from the mine face), in which case the high pressure zone 16 would be on the side of the door system closest the mine face, and the low pressure zone would be on the opposite side of the door system. The door system 20 can also be used in mines having other ventilation configurations.

Figure 14:
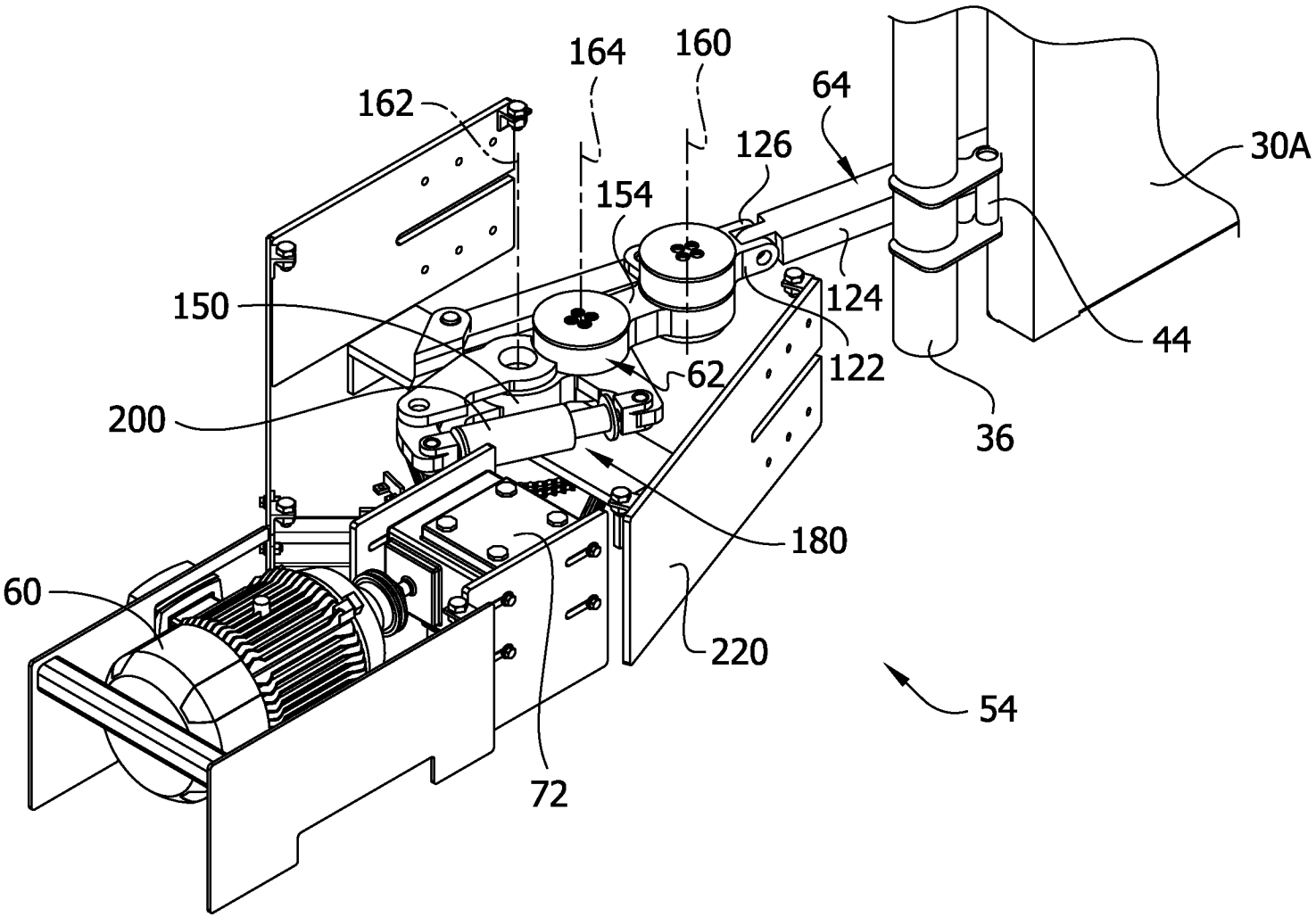
FIG. 14 is fragmentary bottom perspective of the door-moving mechanism showing the door leaf in the open position.

The mine door system 20 comprises a mine door, generally designated 30, adapted to be mounted on a door frame 32 installed in the passageway 14. The door frame 32 defines an entry and comprises a pair of telescoping columns 36 at opposite sides of the door frame and a lintel 40 spanning the columns. The door 30 comprises first and second door leafs 30A, 30B mounted on respective columns 36 by hinges 44, for example, for back and forth swinging movement of the door leafs between a fully-closed position (FIGS. 1 and 10) and a fully-open position (FIG. 14). When the door leafs 30A, 30B are fully closed, they are generally coplanar. Seals (not shown) are secured to the bottom edges of the door leafs 30A, 30B to seal against air flow between the leafs and the mine floor. An astragal seal 50 is secured along the free-swinging vertical edge of the first door leaf 30A to seal against air flow between the two leafs of the door. Desirably (but not necessarily), the seal 50 is secured to the high-pressure face of the first door leaf 30A and overlaps the high-pressure face of the second door leaf 30B when the two door leafs are fully closed. The opening and closing of the two door leafs 30A, 30B are sequenced to preserve the astragal seal. Thus, in an opening sequence, the first door leaf 30A carrying the astragal seal 50 preferably starts to open slightly before or at the same time as the second door leaf 30B starts to open and, in a closing sequence, the second door leaf closes before the first door leaf so that the astragal seal on the first door leaf seals properly against the high-pressure face of the second door leaf. Details on mine door and frame construction as well as other aspects of mine door usage are provided in U.S. Pat. No. 4,911,577 (Mine Door System); U.S. Pat. No. Re. 34,053 (Mine Door System); U.S. Pat. No. 5,168,667 (Door System for Mine Stopping); U.S. Pat. No. 5,222,838 (Power Mine Door System); U.S. Pat. No. 5,240,349 (Power Mine Door System); U.S. Pat. No. 6,032,986 (Door System for Mine Stopping); U.S. Pat. No. Re. 36,853 (Mine Door System); U.S. Pat. No. 6,164,871 (Mine Stopping Having a Swinging Door) and U.S. Pat. No. 6,425,820 (Mine Door Power Drive System), all of which are assigned to Jack Kennedy Metal Products, Inc. of Taylorville, Ill., all of which are hereby incorporated herein by reference.

The mine door system 20 also includes first and second articulated door-moving mechanisms, generally designated 54, 56 (FIG. 1), for moving respective first and second door leafs 30A, 30B from their fully-closed positions to their fully-open positions. The door-moving mechanisms 54, 56 are each mounted in an enclosure or housing 220 secured in suitable fashion (e.g., welded or fastened) to the lintel 40 of the door frame 32. The housing 220 extends like a cantilever from the lintel 40 and is supported at its free (outer) end by a brace 224. In the illustrated embodiment, the door-moving mechanisms 54, 56 are substantially identical, so only the first mechanism 54 will be described in detail. However, in other embodiments, the second door-moving mechanism 56 may differ from the first mechanism 54. Although FIG. 1 illustrates a double-leaf door installation, the technology described herein can be applied to both single-leaf door installations and double-leaf door installations. For example, a single one of the door-moving mechanisms can be used to control movement of a single door leaf of a single-leaf door installation in the same way described below. Further, a single one of the door-moving mechanisms can be used to control a double-leaf door installation in combination with a suitable linkage connecting the leaves to one another Each of the door-moving mechanisms 54, 56 suitably articulates between a first configuration in which the mechanism applies a relatively smaller door-moving force to the respective door leaf 30A, 30B and a second configuration in which the mechanism applies a larger door-moving force to the respective door leaf. The door-moving mechanisms 54, 56 suitably move the respective door leaf 30A, 30B at a first speed in the first configuration and move the respective door leaf at a second speed less than the first speed in the second configuration. Details about how to construct such door-moving mechanisms are provided in U.S. Pat. No. 8,800,204, the entire contents of which are hereby incorporated by reference.

Figure 2:
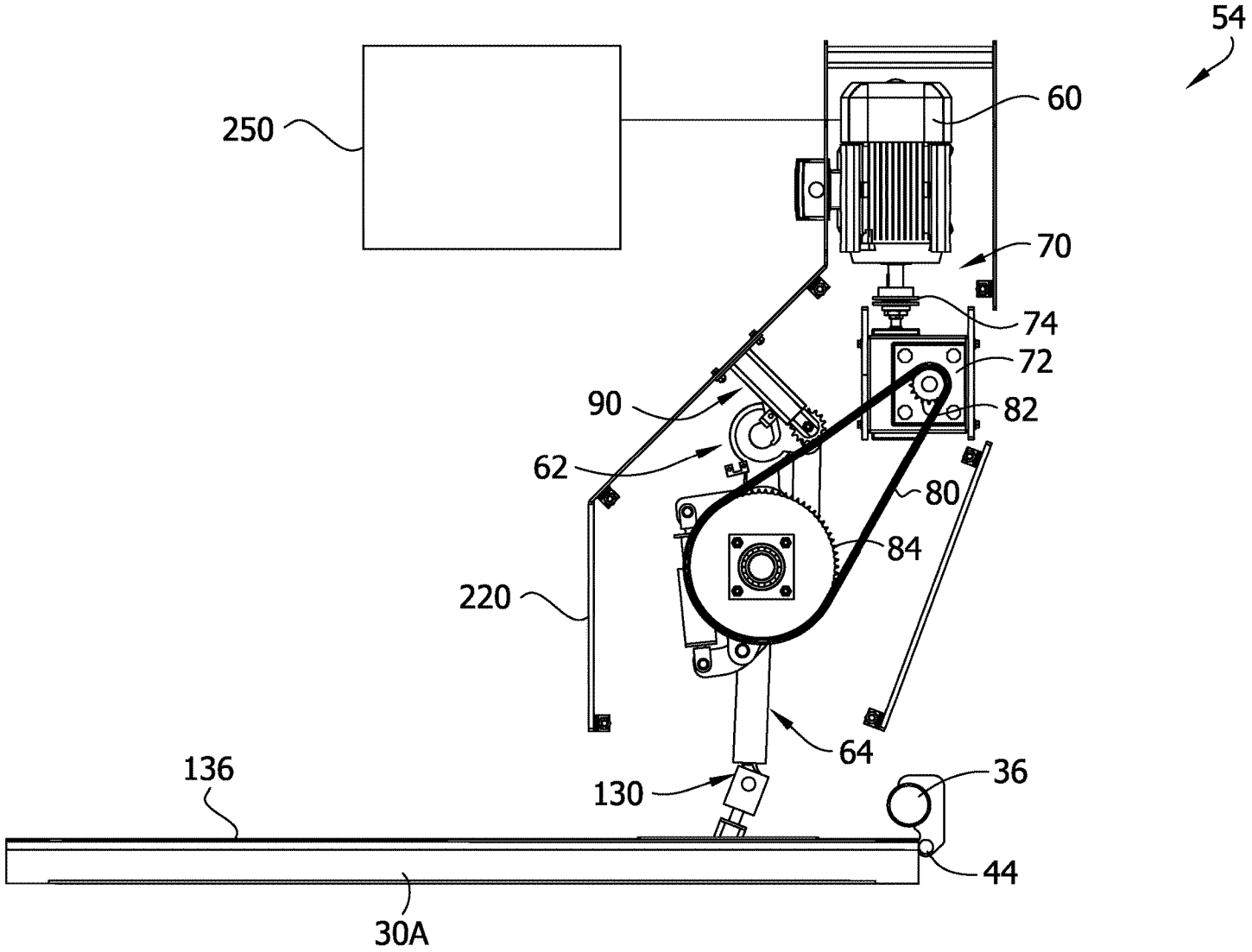
FIG. 2 is a top plan of one embodiment of a door-moving mechanism connected to one of the door leafs of the installation illustrated in FIG. 1, showing the door leaf in the closed position.
Figure 3:
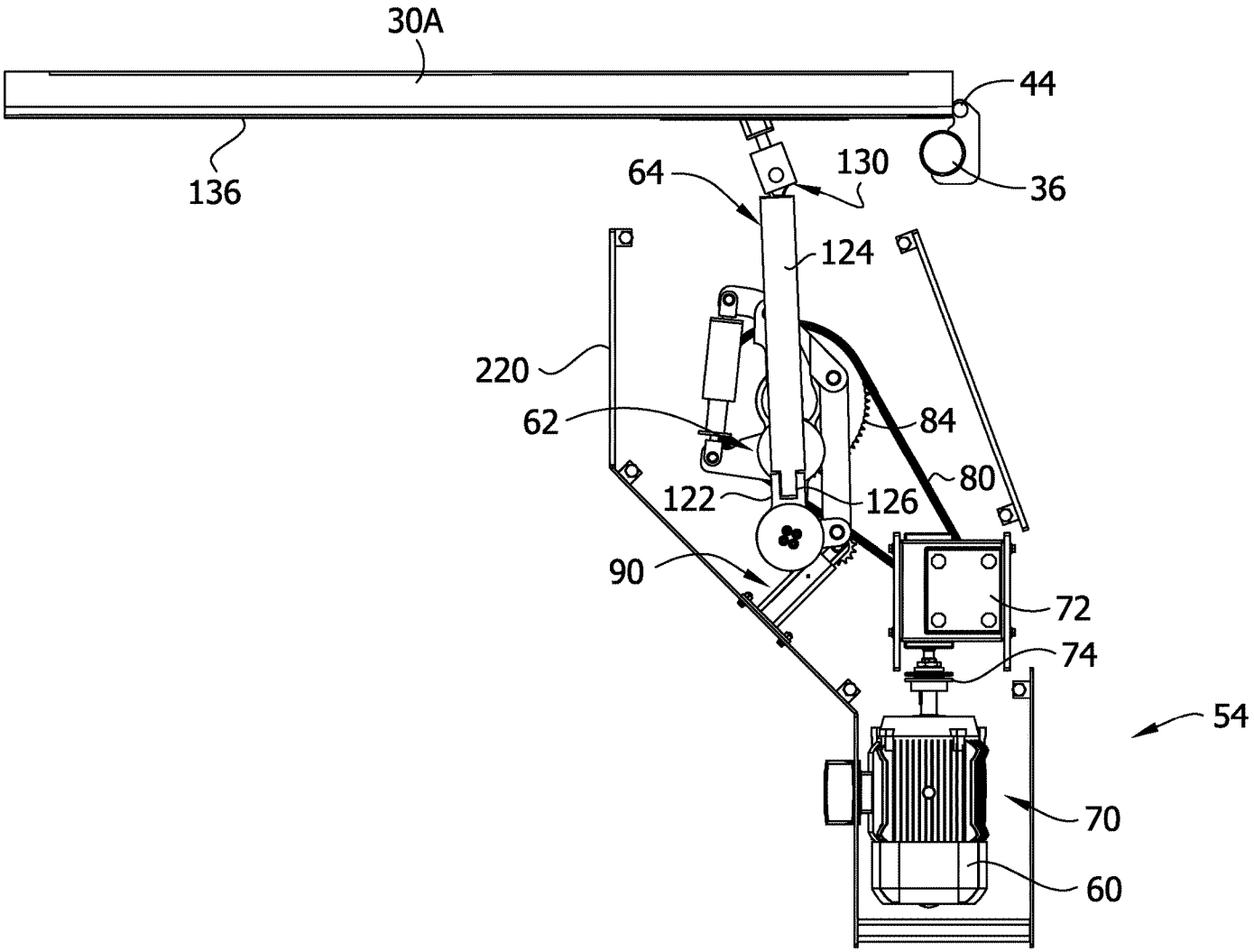
FIG. 3 is a bottom plan of the door-moving mechanism and door leaf illustrated in FIG. 2.

Referring to FIGS. 2 and 3, the first door-moving mechanism 54 is an articulated mechanism comprising a motor 60 for driving pivoting movement of the door leaf 30A, a crank 62 (e.g., a variable-length crank or variable-throw crank) drivingly connected to the motor so the motor can drive rotation of the crank, and an elongate link 64 (e.g., a compound link) connected to the door leaf and the crank so that rotation of the crank by the motor causes the elongate link to swing the door leaf on the hinges 44 back and forth between the closed and open positions. The motor 60 is suitably a non-reversing electric motor, meaning the motor turns its output shaft in only one direction. Likewise, the crank 62 is configured to rotate in a single direction and thereby drive movement of the door leaf 30A from a fully closed position to a fully open position and then back to the fully closed position. Thus, the motor 60 can drive opening and closing movement of the door leaf 30A without reversing directions. It is understood, however, that other types of motors, including non-electric motors and/or reversing motors, can be used without departing from the scope of the invention.

As illustrated in FIGS. 2 and 3, the mechanism 54 includes a drive unit 70 that includes the motor 60 and a speed reducer 72 connected to the motor by a coupling 74. The speed reducer 72 suitably has an output speed in a suitable range such as 0.5-6 rpm, or 3-6 rpm, or about four rpm. A brake (not shown) is suitably provided on the motor 60 and is applied when the motor is off to prevent the door leaf 30A from coasting beyond a desired point (e.g., past positions in which the door is fully open and fully closed). The coupling 74 between the motor 60 and the speed reducer 72 suitably includes a slip clutch to protect the motor and speed reducer in the event the door leaf 30A becomes jammed or blocked. The output shaft of the speed reducer 72 is suitably directed in an upward direction, which is desirable in case the shaft seal fails. Other drive configurations are possible.

An endless belt 80 (e.g., a chain) connects a drive member comprising a sprocket 82 on the output shaft of the speed reducer 72 to a driven member comprising a sprocket 84 affixed to the crank 62. In the illustrated embodiment, the endless belt 80 is a double row chain. Likewise, the sprockets 82, 84 each have two rows of teeth in mesh with the double row chain 80. It is possible to use a single row chain instead of the double row chain if desired. However, the double row chain 80 is more resistant to sagging, which may be desirable in some applications.

Figure 4:
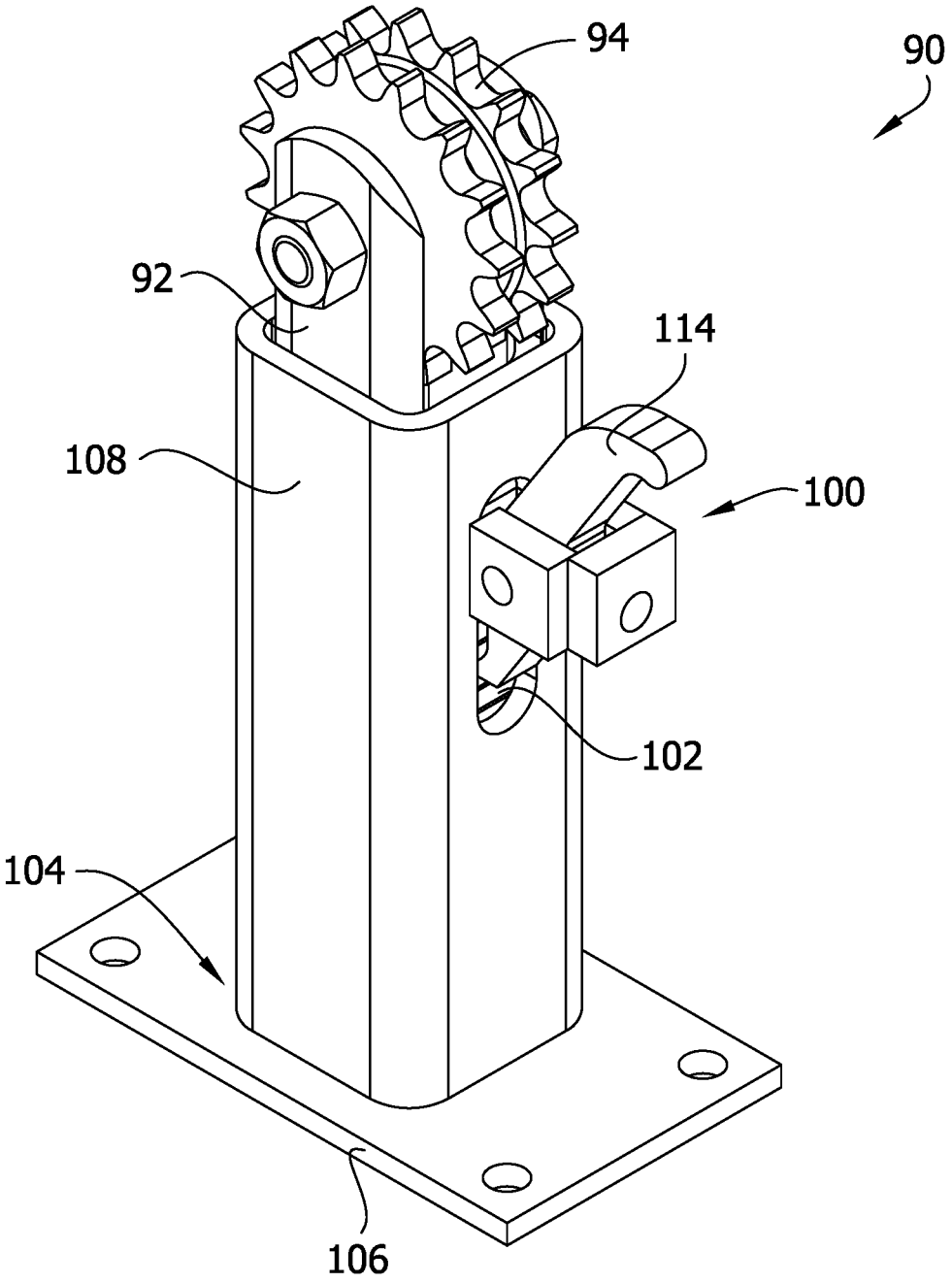
FIG. 4 is a perspective of one embodiment of a ratcheting tensioner suitable for use in the door-moving mechanism in FIGS. 2 and 3.
Figure 5:
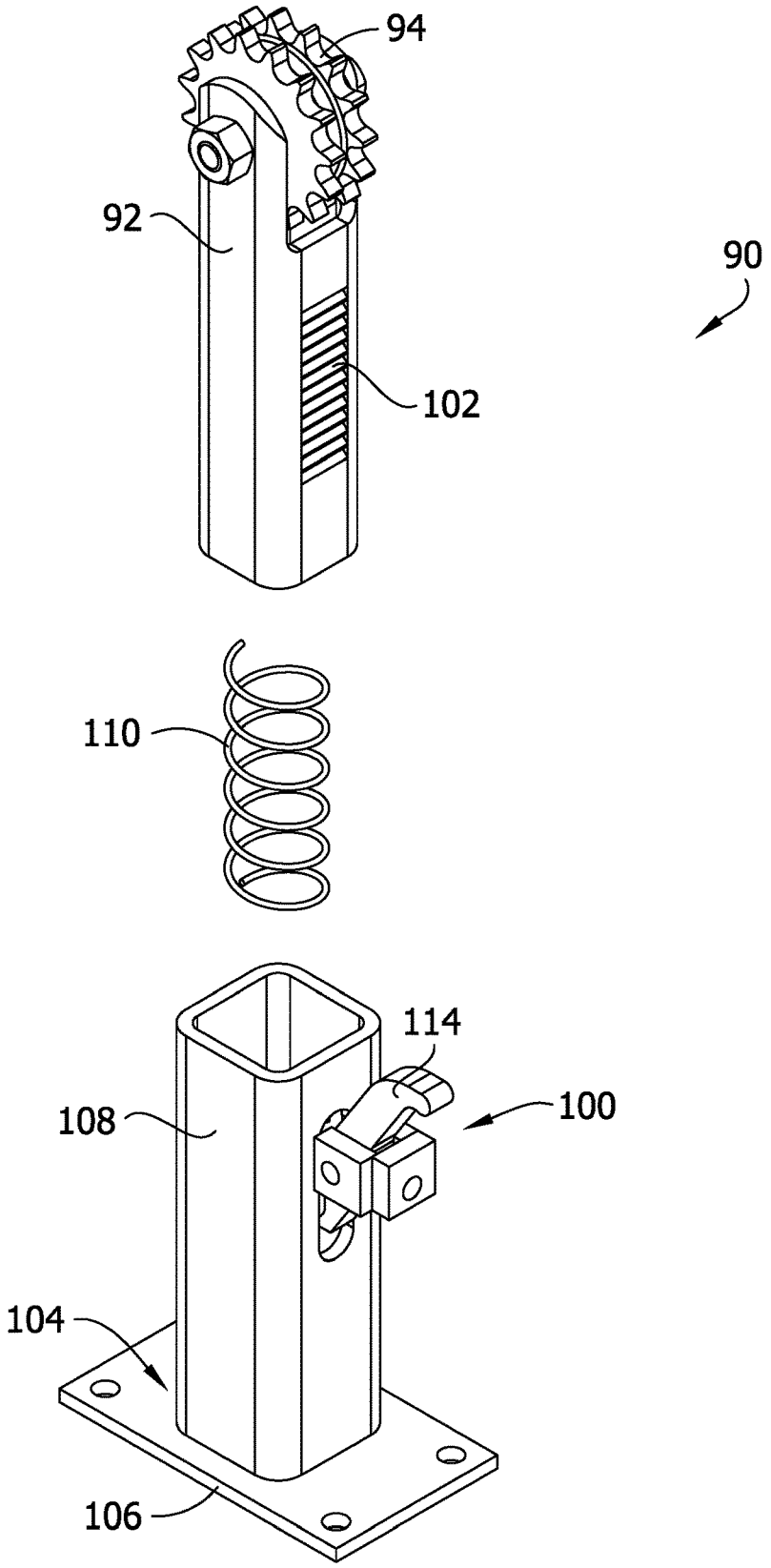
FIG. 5 is an exploded perspective of the ratcheting tensioner illustrated in FIG. 4.

A ratcheting tensioner 90 is positioned to limit slack in the chain 80, as illustrated in FIG. 2. Referring to FIGS. 4 and 5, the ratcheting tensioner 90 comprises an arm 92 and an idler sprocket 94 secured to the arm so the arm can hold the idler sprocket in mesh with the chain 80, as in FIG. 2. The ratcheting tensioner 80 includes a ratcheting mechanism 100 adapted to automatically take up slack in the chain 80 as the chain lengthens due to wear. Referring to FIGS. 4 and 5, there are teeth 102 on the side of the arm 92. The arm 92 is received in an anchor 104. In the illustrated embodiment, the anchor 104 includes a mounting plate 106 secured to the housing 220 of the door-moving mechanism 54 and a hollow tubular guide 108 extending away from the mounting plate. The hollow guide 108 is sized and shaped to receive the arm 92 and allow telescoping movement of the arm relative to the guide. A spring 110 is compressed between the arm 92 and the anchor 104 so the spring biases the arm to extend relative to the anchor. A pawl 114 is mounted on the anchor 104 and positioned so it is moveable between a locking position (FIG. 4) in which the pawl engages the teeth 102 and a non-locking position (not shown) in which the pawl does not engage the teeth.

The pawl 114 is normally in the locking position. A biasing member (not shown) biases the pawl 114 toward its locking position. When the pawl 114 is in the locking position it engages the teeth 102 in a manner that limits retraction of the arm 92 into the hollow guide 108. However, the pawl 114 allows the spring 110 to extend the arm 92 farther out of the hollow guide 108 even when the pawl is in the locking position. When the idler sprocket 94 is in mesh with the chain 80 and the chain is properly tensioned, as illustrated in FIG. 2, the chain holds the arm 92 against the bias of the spring 110 and prevents the spring from extending the arm. However, as the chain 80 lengthens due to wear and the amount of slack in the chain increases, the biasing force from the spring 110 overcomes the opposing force from the chain 80 and the spring automatically slides one or more of the teeth 102 past the pawl 114 and thereby extends the arm 92 toward the chain to take up the excess slack in the chain and maintain a desired amount of tension in the chain. The pawl 114 can be moved (e.g., by a worker) to the non-locking position to retract the arm 92 into the hollow guide 108 (e.g., to reset the ratcheting tensioner in the event an old chain is replaced with a new chain or in the event links are removed from the chain to shorten its length).

Figure 6:
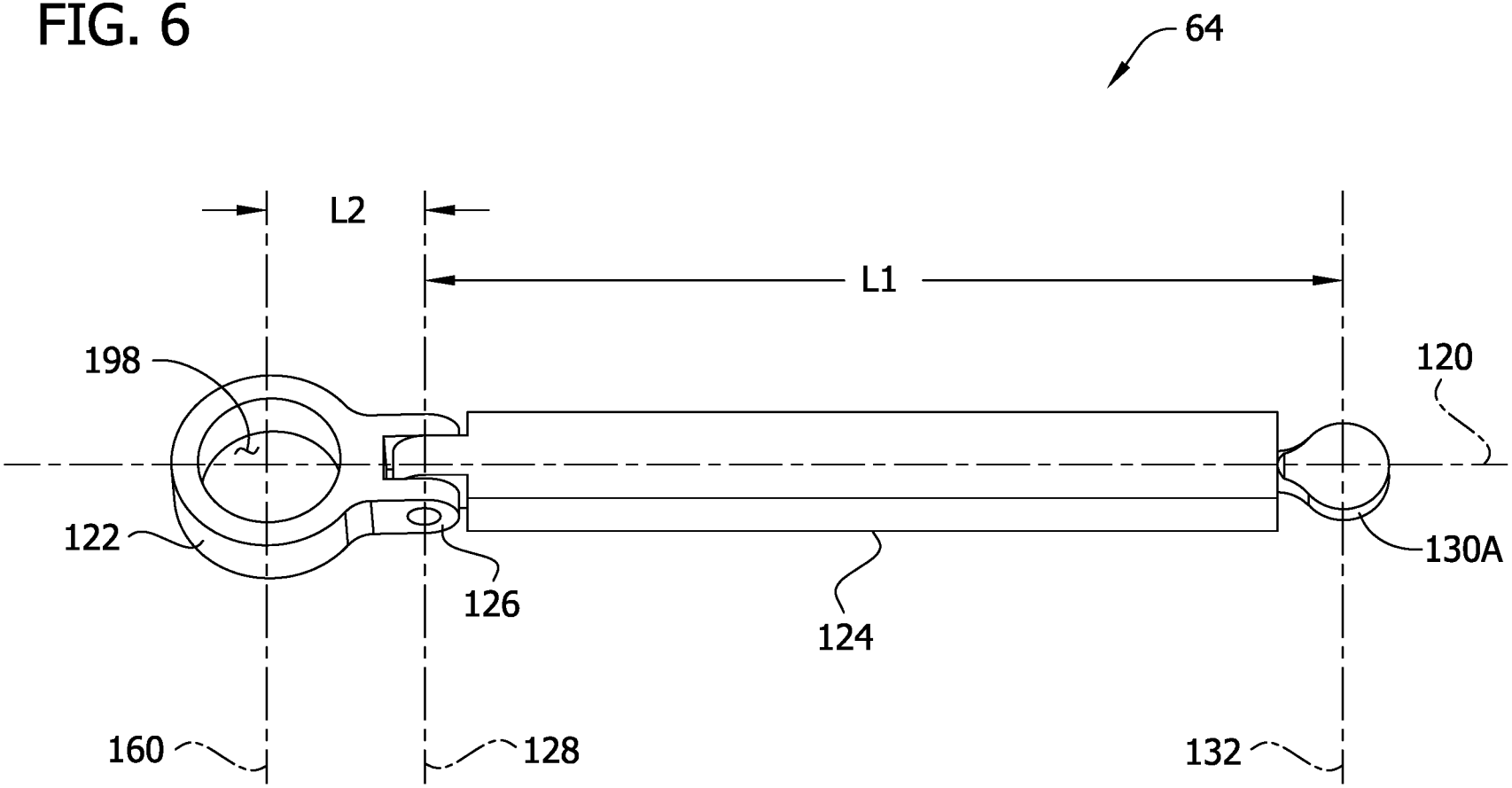
FIG. 6 is a perspective of one embodiment of an elongate compound link of the door-moving mechanism illustrated in FIGS. 2 and 3.

Referring to FIG. 6, the elongate link 64 has a longitudinal axis 120. In the illustrated embodiment, the elongate link 64 is a compound link including first and second rigid members 122, 124 secured together at a pivot connection 126 for pivoting movement relative to one another about a pivot axis 128. The pivot axis 128 is transverse to the longitudinal axis 120 of the elongate link 64. For reasons that will be explained later herein, the second member 124 is longer than the first member 122. Moreover, the first rigid member 122 is adapted for connection to the crank 62 about a pivot axis 160. The second rigid member 124 is adapted for connection to the door leaf for rotation about an axis of rotation 132 on the opposite side of the pivot connection 126 in the elongate link 64. The distance L1 between the axis of rotation 132 where the elongate link 64 is connected to the door leaf 30A and the pivot connection 126 in the elongate link is longer than the distance L2 between the pivot axis 160 where the elongate link is connected to the crank 62 and the pivot connection 126. For example, the ratio of the length L1 to the length L2 is suitably at least about 5, and more suitably at least about 8.

Figure 7:
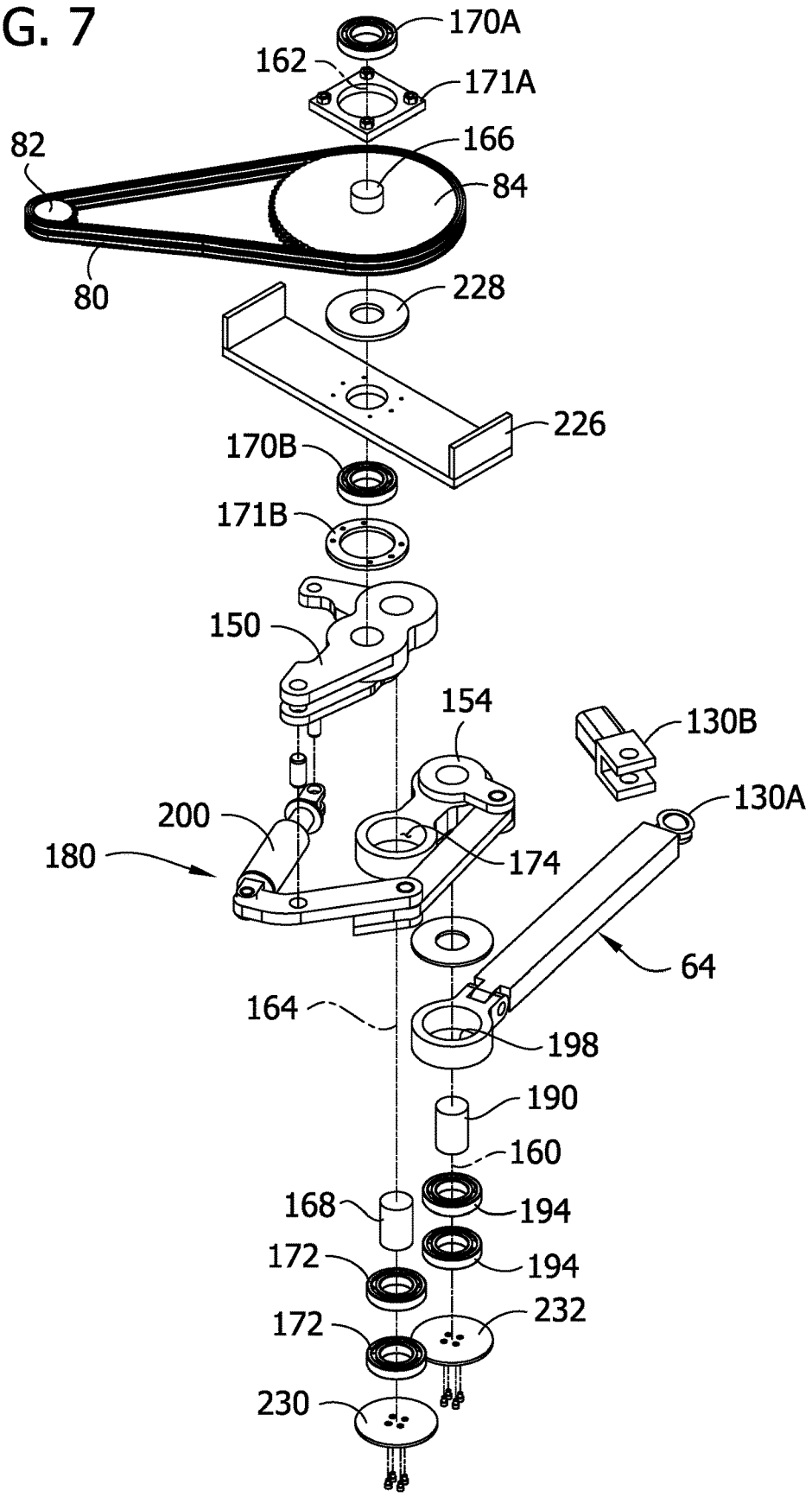
FIG. 7 is an exploded perspective of components of the door-moving mechanism illustrated in FIGS. 2 and 3 that are connected between a door leaf and a motor of the installation in FIG. 1.
Figure 8:
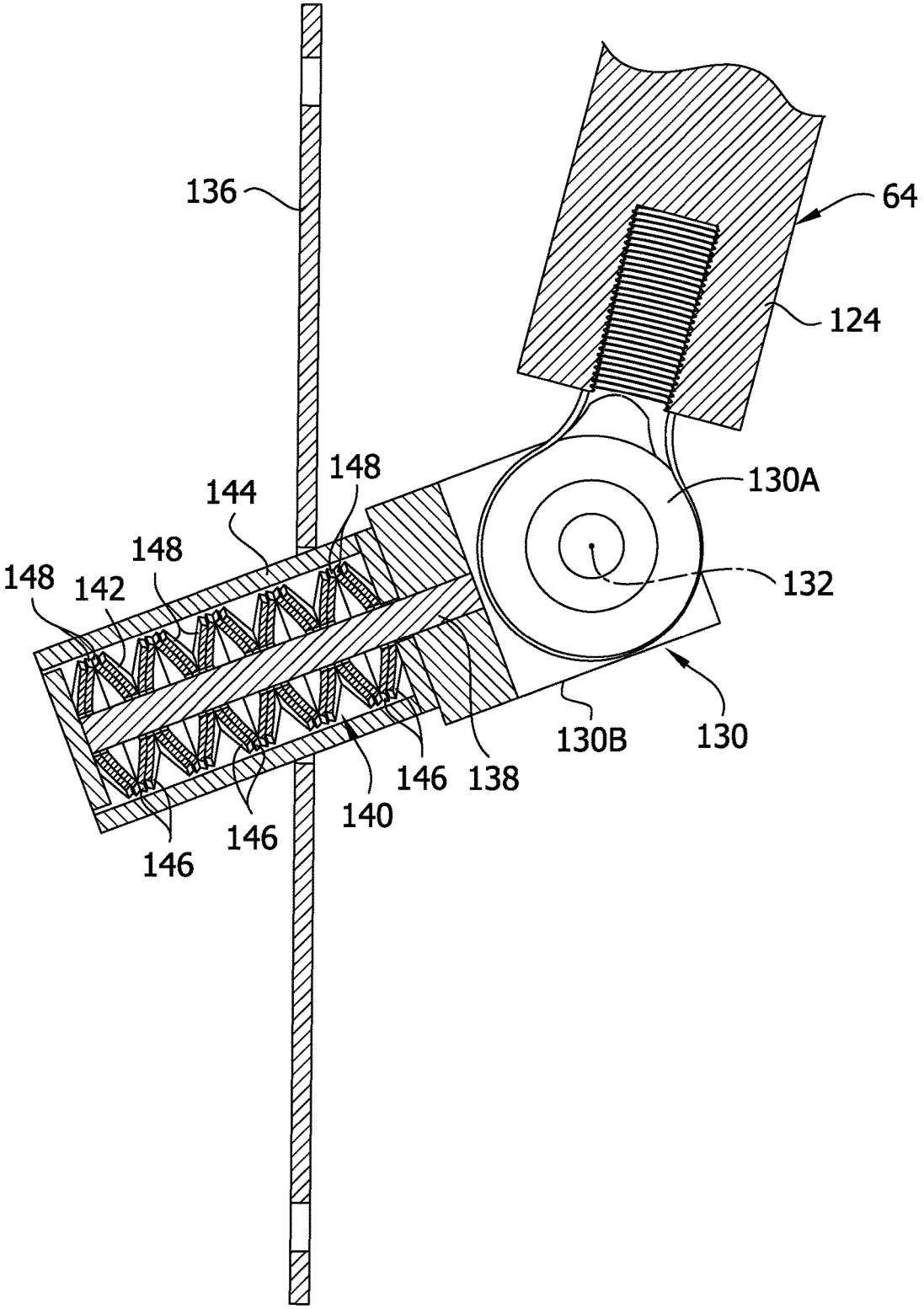
FIGS. 8 and 9 are a fragmentary cross sections showing a connection between the door-moving mechanism in FIGS. 2 and 3 and a panel of the door leaf in a relatively retracted configuration (FIG. 8) and a relatively extended configuration (FIG. 9)

Referring to FIGS. 6-8, the second (longer) rigid member 124 is connected to the door leaf by a ball joint generally designated 130. In this embodiment, the ball joint 130 includes a ball 130A affixed to the door end of the rigid member 124 and a U-shaped member 130B configured for holding the ball 130A while allowing rotation of the ball relative to the member 130B. The ball joint 130 allows the elongate link 64 and door leaf 30A to rotate relative to one another on multiple different axes, including but not limited to the rotational axis 132 in FIG. 6. Although the ball joint 130 may provide advantages in some installations, it is understood the ball joint can be replaced by a clevis connection or universal joint without departing from the scope of the invention. If the ball joint 130 is replaced with a clevis connection or universal joint, the distance L1 is defined as the distance between the pivot axis of the clevis connection or universal joint and the pivot connection 126 in the compound elongate link 64.

Figure 9:
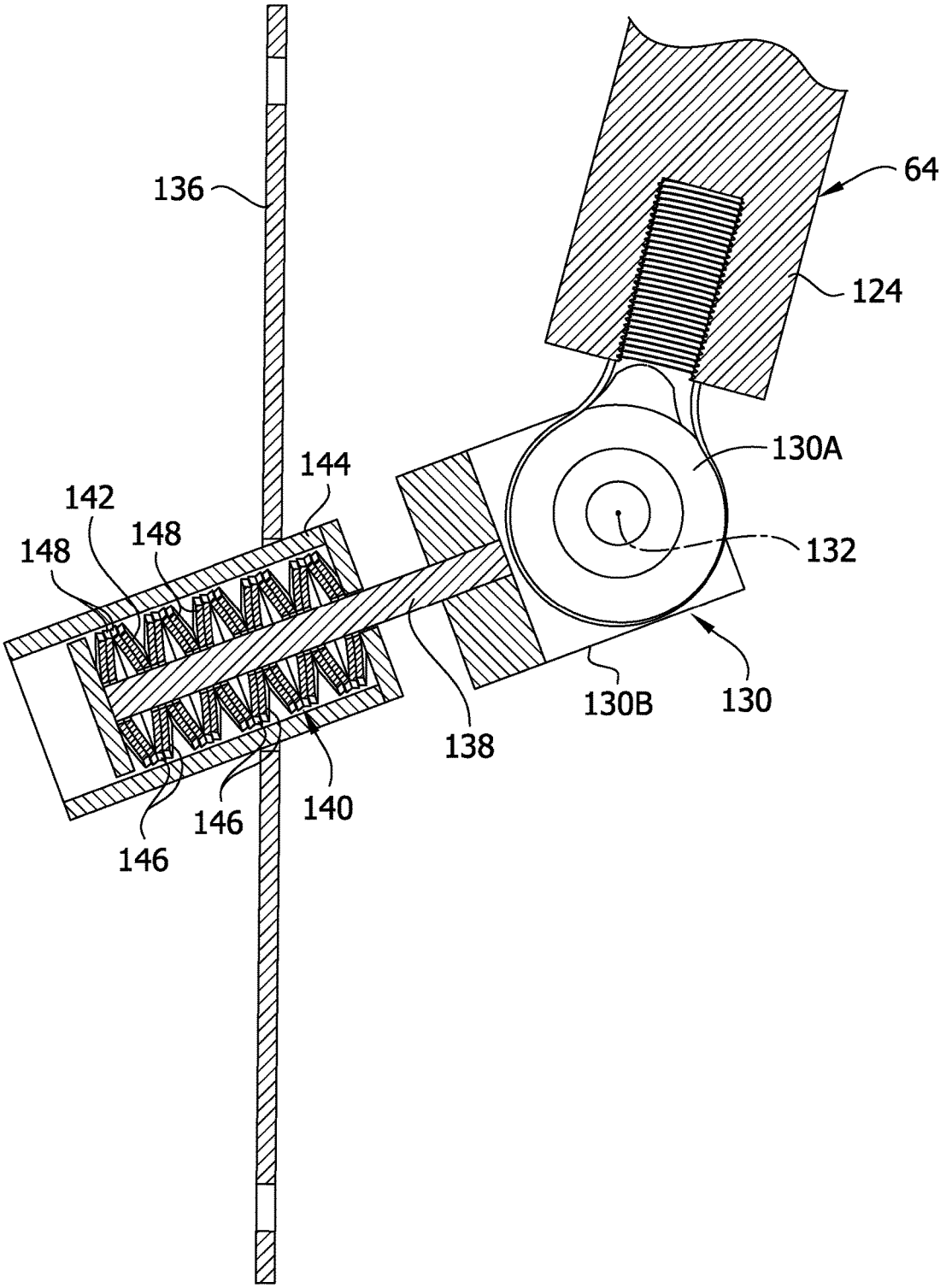

Referring to FIGS. 8 and 9, the door leaf 30A includes a panel 136 and a drawbar 138 extending from the panel. The second rigid member 124 is connected to the drawbar 138 by the ball joint 130 adjacent an end of the drawbar. The door leaf 30A is adapted to allow the draw bar 138 to move relative to the panel 136 from a retracted position (FIG. 8) to an extended position (FIG. 9) farther from the panel. The door leaf 30A includes a draw bar biasing member 140 arranged to bias the draw bar toward the retracted position. For example, a suitable biasing member can be formed by stacking a series of spring washers 142 between the drawbar 138 and a drawbar anchor 144 secured to the panel 136 and in which the drawbar is telescopingly received. Those skilled in the art will recognize this arrangement of stacked spring washers as a Belleville spring.

One of the features of a Belleville spring is that the damping characteristics of the spring can easily be adjusted by changing the way the washers are oriented relative to one another. In this regard, a typical Belleville spring has a "series" configuration if all adjacent washers are facing opposite directions. This configuration provides the least resistance and the largest stroke for a given number of washers. A typical Belleville spring has a "parallel" configuration if one or more adjacent springs are stacked facing the same direction. A common configuration is for a first pair of two washers to be stacked in the same direction (i.e., in parallel) and facing a second pair of washers stacked in the same direction but opposite the direction of the first pair. This arrangement provides twice the resistance (albeit with a reduced stroke) than four spring washers facing alternating directions.

Referring again to FIGS. 8 and 9, the biasing member 140 is a Belleville spring having a configuration in which the washers of a first set of washers 146 are arranged relative to one another so they are stacked next to one another and have the same orientation. These washers 146 are nested with one another. The washers of a second set of washers 148 are arranged relative to one another so they are stacked next to one another but have the opposite orientation. The sets 146, 148 are not mutually exclusive and it is possible that a particular washer may be stacked between first and second washers so it is included in the first set 146 by virtue of it being nested with the first washer and also included in the second set 148 by virtue of it being stacked next the second another washer in an opposite orientation as the second washer. When the washers 142 are compressed the washers of the first set of washers 146 slide across one another, resulting in a lot of friction compared to the washers of the second set of washers 148. Thus, the damping of the spring 140 can be increased by including more washers stacked next to one another in the same orientation (i.e., nested) to form the stack. On the other hand, the damping of the biasing member 140 can be decreased by including more washers stacked next to one another in the opposite orientation to form the stack. This will be discussed in more detail later herein.

Figure 10:
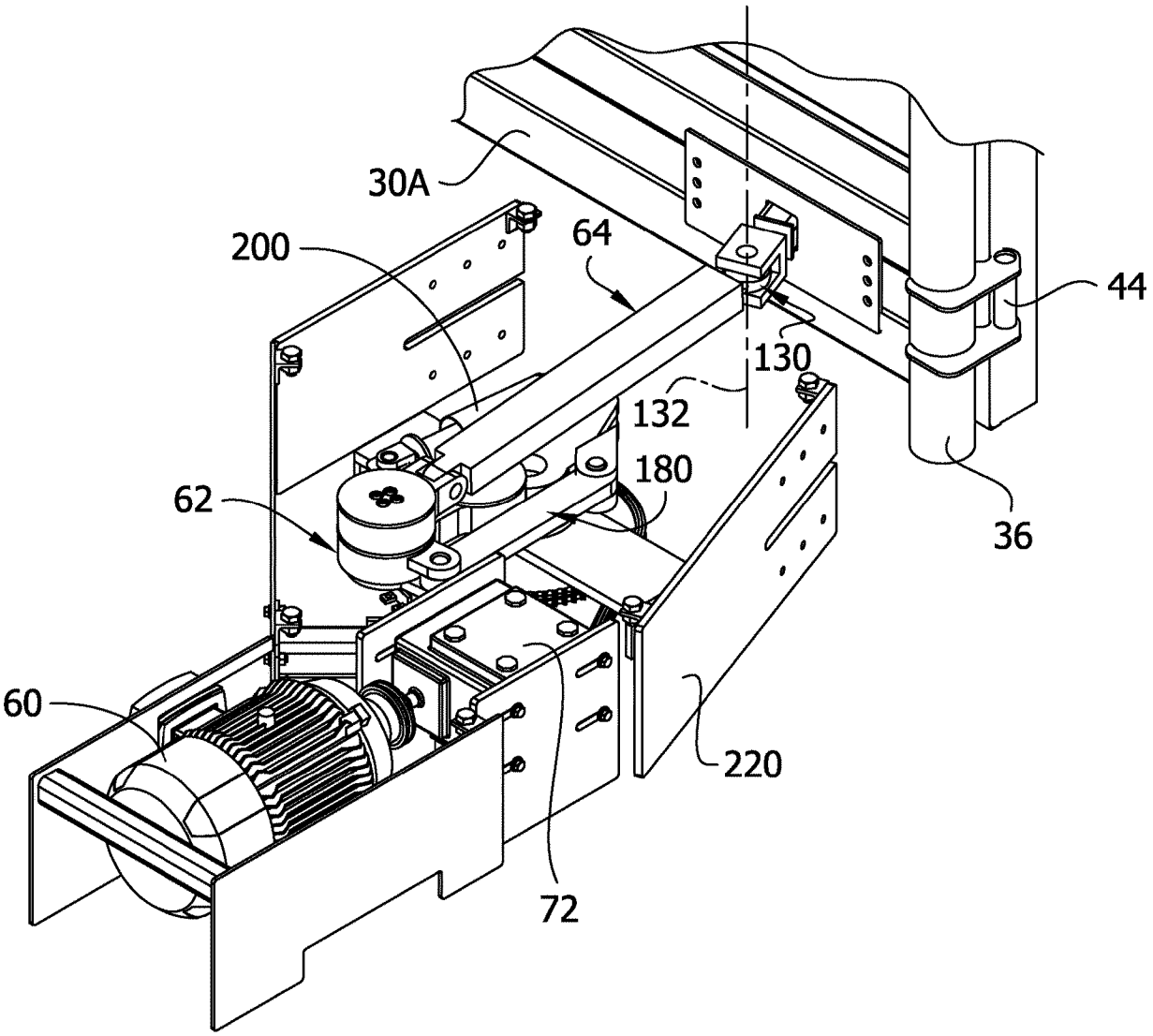
FIG. 10 is fragmentary bottom perspective of the door-moving mechanism showing the door leaf in a closed position.

Referring to FIGS. 6, and 8-10, the elongate link 64 is connected to the door leaf 30A in a manner that allows rotation of the elongate link relative to the door leaf 30A about the first vertical axis 132 (FIG. 10). The crank 62 is connected to the elongate link 64 for rotational movement relative to the elongate link about a second generally vertical axis 160 (FIG. 11), which is spaced from the first vertical axis 132. The sprocket 84 rotates the crank 62 about a third generally vertical axis 162 (FIG. 11) spaced from the second axis 160 thereby to apply, via the mechanical link 64, an opening/closing force to the door leaf 30A.

In the illustrated embodiment (see FIG. 7), the crank 62 is a variable-throw (variable-length) crank comprising first and second crank arms 150, 154 connected for pivotal movement relative to one another about a fourth generally vertical axis 164 (FIG. 11) located between the second and third vertical axes 160, 162. Referring again to FIG. 7, a first shaft 166 rigidly secured (e.g., welded) to the first crank arm 150 connects the first crank arm 150 to the driven sprocket 84 through upper and lower bearings 170A, 170B on opposite sides of the sprocket. The upper bearing 170A is supported by bearing retainer 171A affixed to the enclosure 220. The lower bearing 170B is supported by a bearing retainer 171B fastened to the bottom surface of a bracket 226 affixed to the enclosure 220. The hub of the sprocket 84 bears on a disc 228 supported by the bracket 226. The sprocket shaft 166 extends through aligned openings in the disc 228 and bracket 226. The shaft 166 has a central axis coincident with the third vertical axis 162 and is keyed so that the shaft and sprocket 84 rotate in unison about the third axis. Another shaft 168 rigidly secured (e.g., welded) to the first crank arm 150 extends down through bearings 172 received in an opening 174 in the second crank arm 154. The second crank arm 154 is supported by a plate 230 affixed (e.g., by screws) to the shaft 168. The shaft 168 has a central axis coincident with the fourth pivot axis 164 and rotates freely relative to the second crank arm 154 about the fourth axis. The range of such relative rotational movement between the crank arms is limited by a stop mechanism 180, which in the illustrated embodiment includes a mechanical linkage having a limited range of motion. Another shaft 190 rigidly affixed (e.g., welded) to the second crank arm 154 connects the crank arm 154 to the elongate link 64 through bearings 194 received in an opening 198 in the elongate link 64. The link 64 is supported by a plate 232 affixed (e.g., by screws) to the shaft 190. The shaft 190 has a central axis coincident with the second pivot axis 160 and rotates freely relative to the elongate link 64 about the second axis.

As will be described in more detail below, the variable-throw crank 62 articulates between a first configuration (e.g., FIGS. 14 and 15) in which it has a longer length and applies a relatively smaller door-moving force to its respective door leaf 30A, 30B and a second configuration (FIGS. 16 and 17) in which the crank has a shorter length and applies a larger door-moving force to the door leaf. The "length" of the crank 62 as used herein is the straight-line distance between the second and third pivot axes 160, 162. Compare FIGS. 14 and 15 in which the 2nd, 3rd, and 4th pivot axes 160, 162, 164 lie on a substantially straight line (longer configuration) to FIG. 17 in which the 2nd, 3rd, and 4th pivot axes are not substantially all on the same line (shorter configuration).

The crank 62 assumes its first or "lengthened" configuration (e.g., FIGS. 14 and 15) when the door leaf 30A is under a relatively light load condition. In this configuration, the second, third and fourth pivot axes 160, 162, 164 are substantially in alignment, and the length or "throw" of the crank 62 is increased to a "full-throw" or "full-length"

condition. As a result, rotation of the crank 62 about the third vertical axis 162 generates less door-moving force.

The crank 62 assumes its second or "shortened" configuration (FIGS. 16 and 17) during conditions when the door leaf 30A is under a relatively heavy load condition, such as when breaking the initial air load when the door starts to open or when accelerating the door leaf when the door starts to close. In this second configuration the second, third and fourth vertical axes 160, 162, 164 are substantially out of alignment and the length or "throw" of the crank 62 is correspondingly reduced to a "reduced-throw" or "reduced-length" configuration. As a result, rotation of the crank 62 about the third axis 162 automatically generates more door-moving force.

Figure 15:
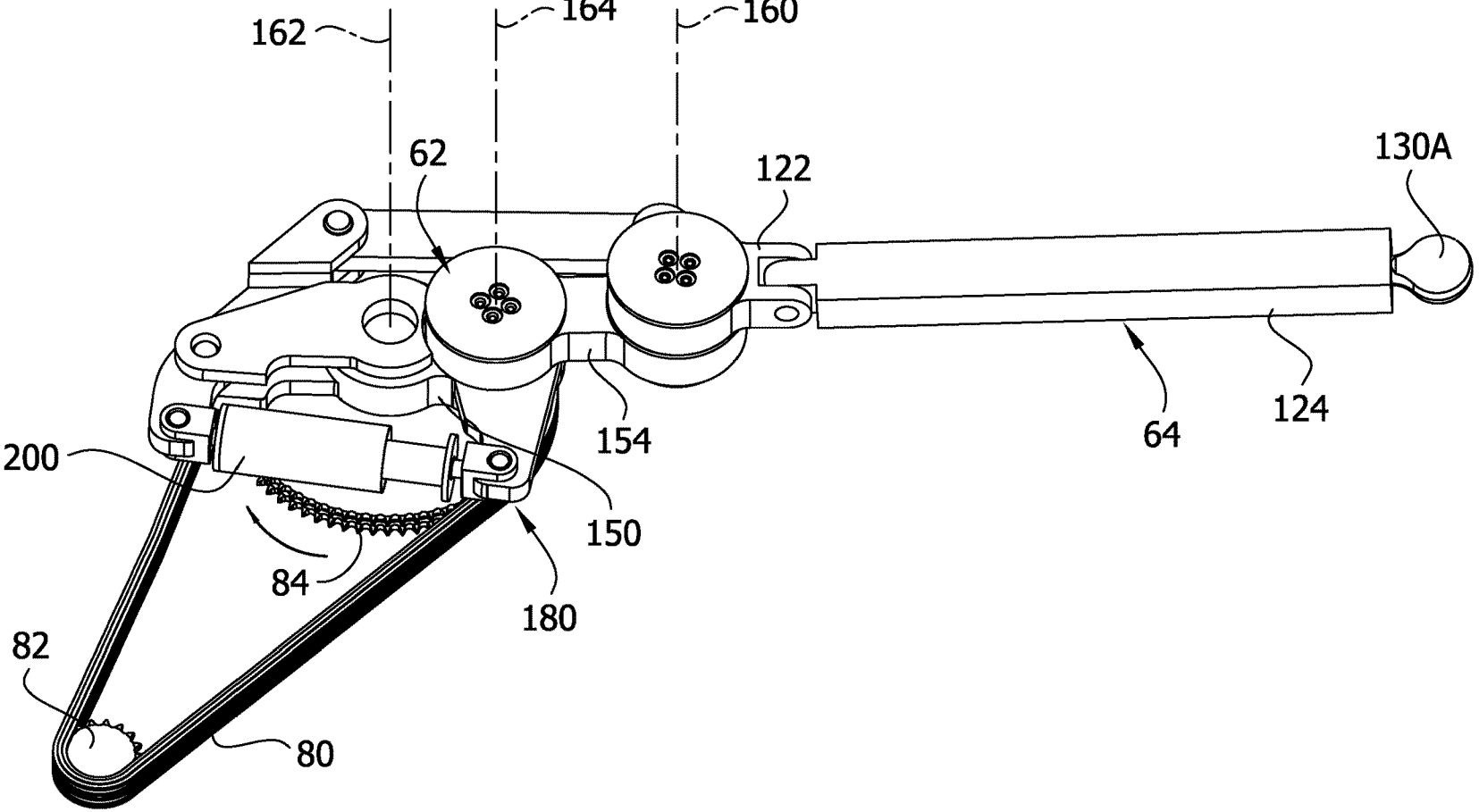
FIG. 15 is an enlarged bottom perspective of the crank as illustrated in FIG. 14.

The change of the length of the crank 62 also affects the speed at which the door leaf 30A moves. In this regard, the speed at which the door leaf 30A moves is a function of both the angle of the crank 62 (as it rotates around axis 162) and the length of the crank. In particular, the crank-angle component of speed is substantially zero when the crank angle is zero, i.e., when the first, second, third, and fourth vertical axes 160, 162, 164 are substantially aligned ("dead-center"). The crank 62 suitably assumes a first dead-center position when the door leaf 30A is fully closed (FIGS. 10 and 11) and another dead-center position when the door leaf is fully open (FIGS. 14 and 15). The crank-angle component of the door-moving speed increases smoothly from zero as the crank 62 begins to open the door leaf 30A to maximum value and then decreases smoothly back to zero as the crank 62 moves the door leaf into its fully open position. Similarly, the crank-angle component of the door-moving speed increases smoothly from zero as the crank 62 begins to move the door leaf 30A from its fully open position back toward its closed position up to a maximum value and then decreases smoothly back to zero as the crank 62 moves the door leaf back to its fully closed position. The crank-throw component of speed varies from a relatively large value when the crank 62 is in its first (longer) configuration and a smaller value when the crank is in its second (shorter) configuration. The speed at which the door moves at any given time is a function of the crank-angle speed component and the crank-throw speed component, given a constant input drive speed.

Figure 16:
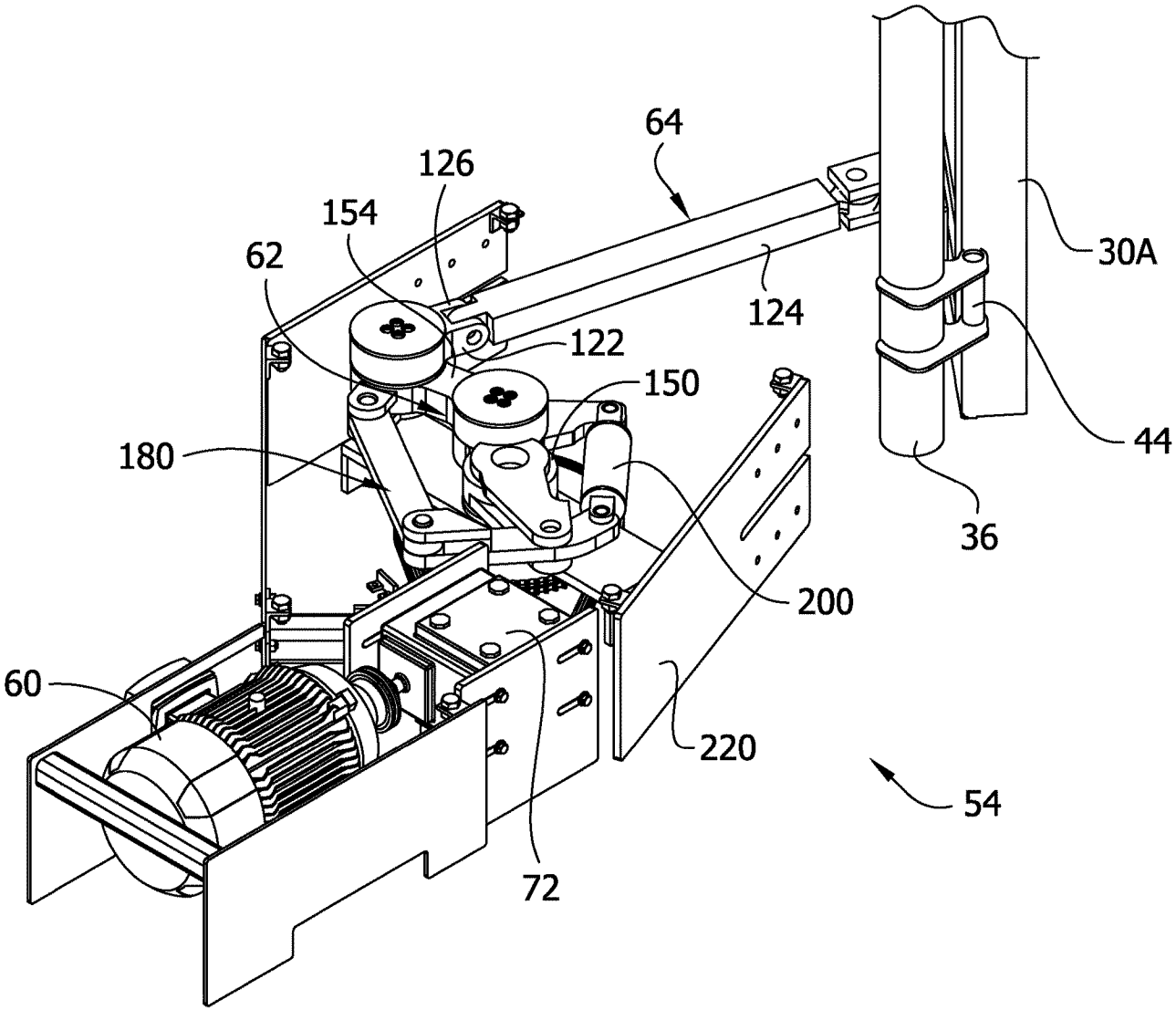
FIG. 16 is fragmentary bottom perspective of the door-moving mechanism showing the door-moving mechanism moving the door leaf under a heavy load.
Figure 17:
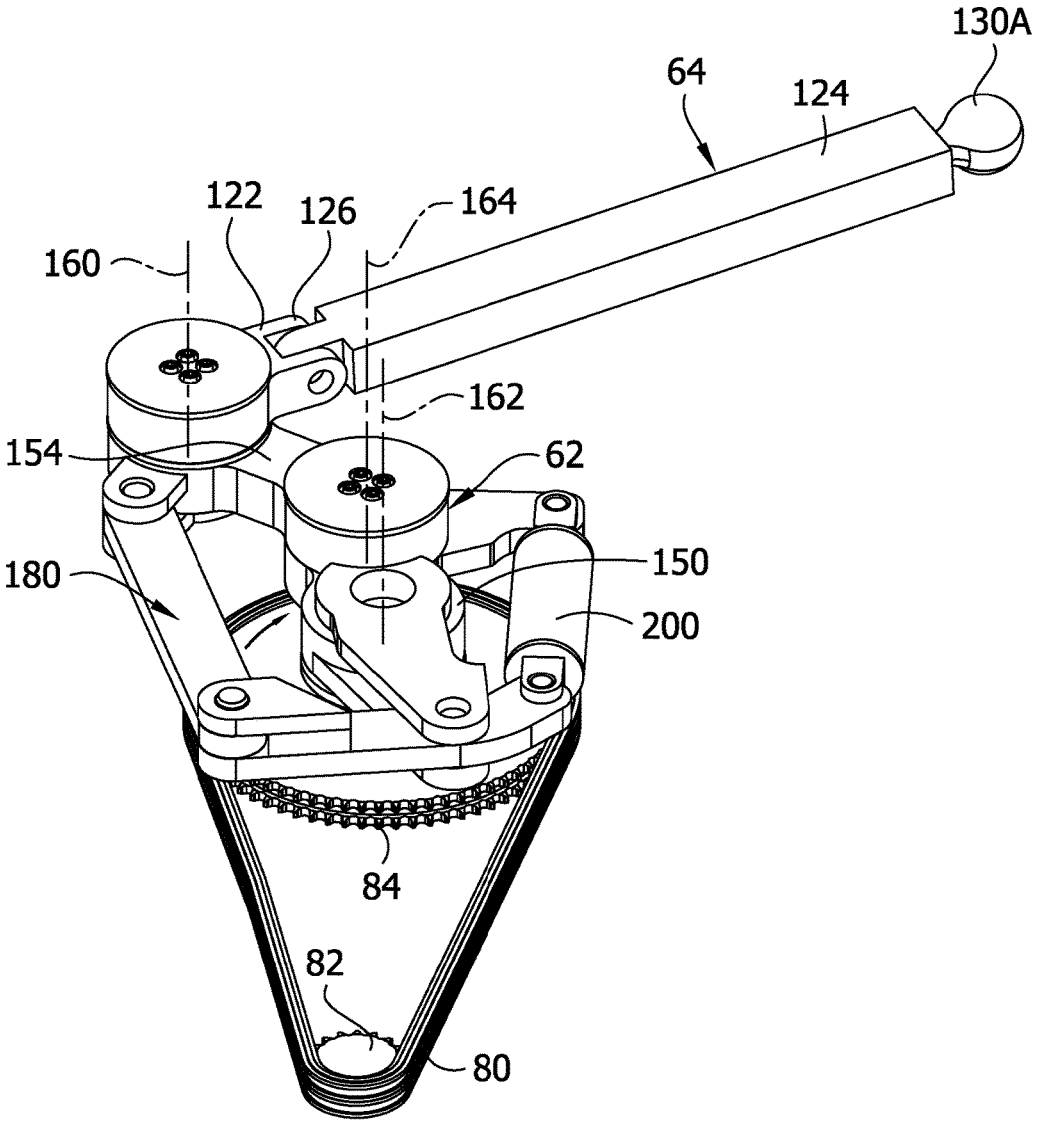
FIG. 17 is an enlarged bottom perspective of the crank as illustrated in FIG. 16.
Figure 18:
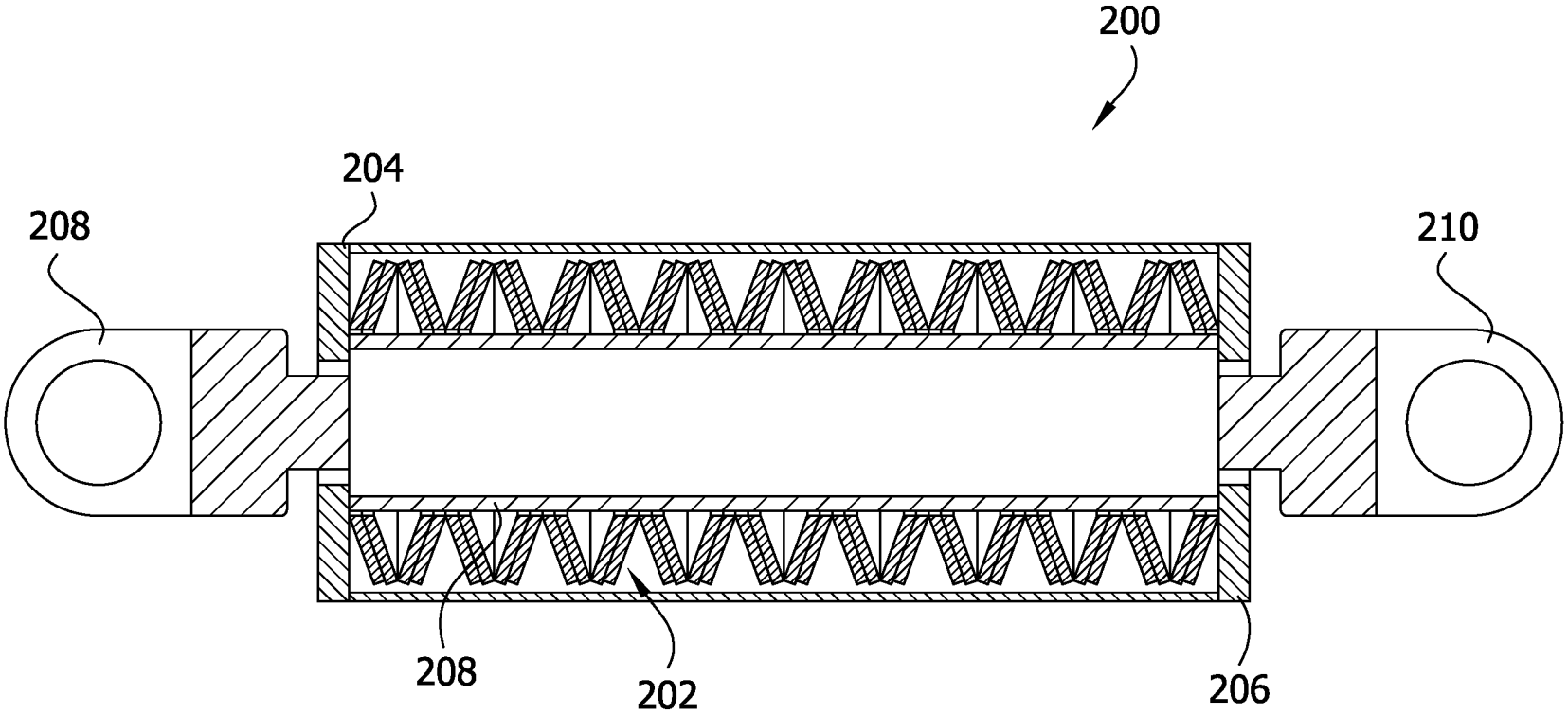
FIG. 18 is a schematic cross section of one embodiment of a crank biasing member.

A holding device 200 holds the variable-throw crank 62 in its first (full-throw) configuration in which the second, third and fourth vertical axes 160, 162, 164 are substantially in alignment. In the illustrated embodiment, the holding device 200 is a variable-length linkage member biased by a crank arm biasing member 202 (FIG. 18) toward a longer configuration (FIGS. 14 and 15) and reconfigurable by compressive forces to a shorter configuration (FIGS. 16 and 17). Referring to FIG. 18, the variable-length linkage member 200 suitably includes a spring 202 compressed between two telescoping members 204, 206. Each of the telescoping members has a clevis connection 208, 210 for connecting the variable-length linkage member 200 to the other members of the linkage that forms the stop mechanism 180. As illustrated, the spring 202 is suitably a Belleville spring formed by stacking a plurality of spring washers 212 between the telescoping members 204, 206. As noted earlier regarding the drawbar biasing member 140, the damping of a Belleville spring can be adjusted by changing the way the washers 212 are arranged relative to one another to either increase or decrease friction between the washers.

In the illustrated embodiment, the variable-length linkage member 200 is part of the stop mechanism 180. In particular, there is a limit to the amount the variable-length linkage member can be shortened under compression. Once the linkage member 200 has been shorted as much as it can be shortened, as in FIGS. 16-18, further pivoting movement of the first and second crank arms 150, 154 relative to one another to shorten the crank 62 is prevented. The spring 202 is configured to hold the crank 62 in its first (full-throw) configuration until the force required to move the door leaf 30A exceeds a predetermined amount, as during heavy load conditions, at which point the spring will deflect resiliently (i.e., compress) under the load and allow the crank to move to its second (reduced-throw) configuration. When the force required to move the door leaf 30A falls below the predetermined amount, the spring 202 will return (i.e., decompress) under its own resilient power to its "home" configuration, as in FIGS. 11-15, to force the crank 62 back toward its first configuration (full-throw) configuration. Other types of springs and spring arrangements can be used for holding the crank 62 in a full-throw (increased-throw) configuration during light-load conditions while allowing the crank to move to a reduced-throw configuration during heavier load conditions. The amount of force required to deflect the spring 202 will depend on the configuration of the spring and its spring characteristics. The force to be exerted by the spring is selected based on such factors as the size of the door leaf 30A, operating speed, friction, and the power of the drive motor 60. The spring 202 should have sufficient power to straighten the crank 62 by overcoming the various frictions in the system, such as door seal flaps dragging on the floor of the mine, after the load on the door leaf decreases.

A suitable control system 250 (FIG. 2) is provided for controlling the operation of the motor 60 of the door-moving mechanism 54. (The same or similar control system is used for controlling the operation of the other door-moving mechanism 56.) In one embodiment, the control system 250 is mounted close to the mine door 30 for operation by a person near the door. The control system can include a programmable processor for programming the opening and closing sequence and/or speeds of the door leafs. The control system may also be used to control signal lights and alarms associated with the mine door.

Figure 11:
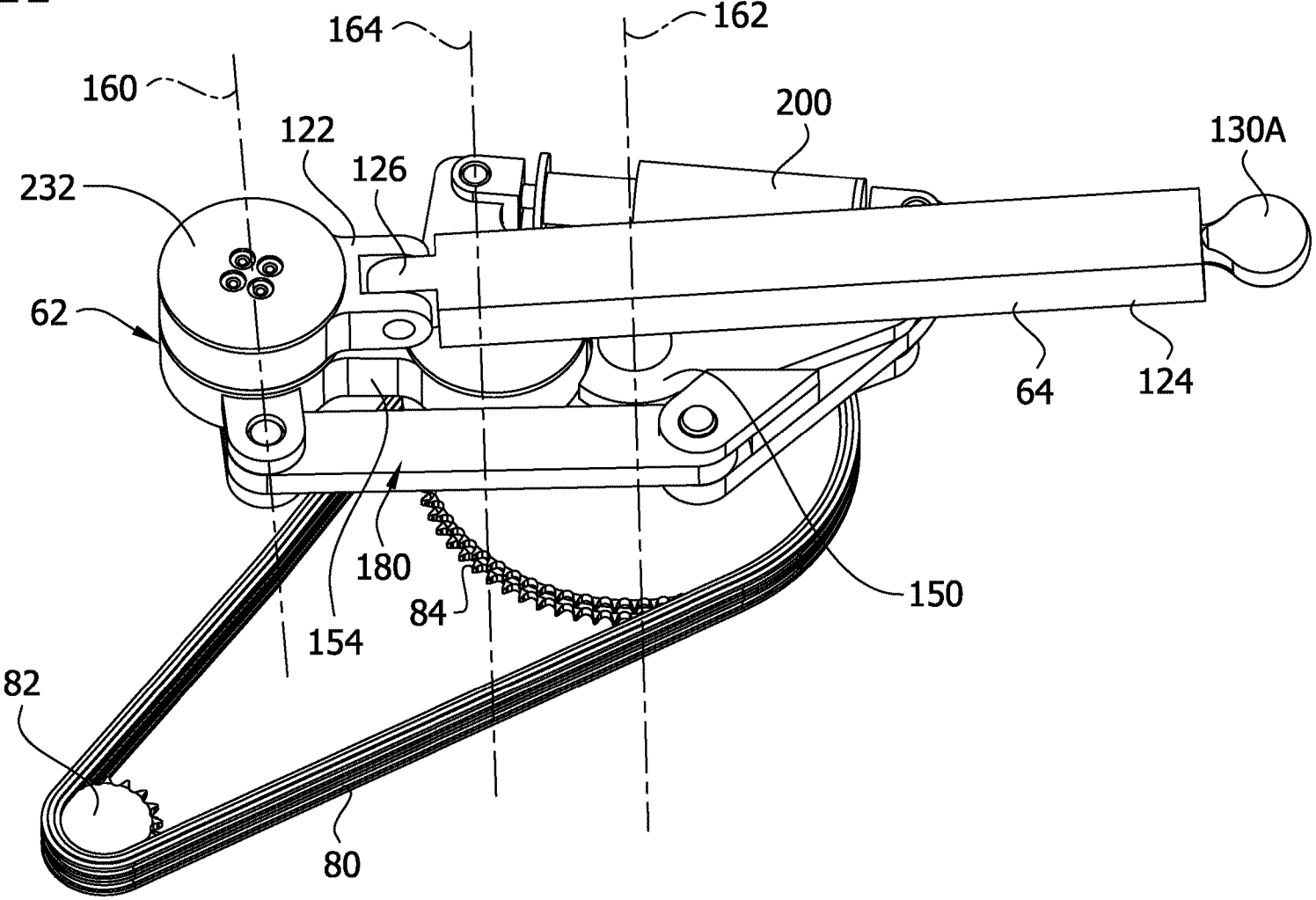
FIG. 11 is an enlarged bottom perspective of the crank as illustrated in FIG. 10.

FIGS. 10-17 illustrate one possible opening and closing sequence of the first door leaf 30A. FIGS. 10 and 11 show the configuration of the door-moving mechanism when the first door leaf 30A is in its fully closed position in which the door leaf is closely adjacent or bearing against the lintel 40. In this position, the crank 62 is in its first (full-throw) configuration and in (or close to) a dead-center position in which the second, third and fourth vertical axes 160, 162, 164 are substantially aligned and the fourth axis 164 at the connection between the two crank arms 150, 154 is located between the second and third axes 160, 162.

Figure 12:
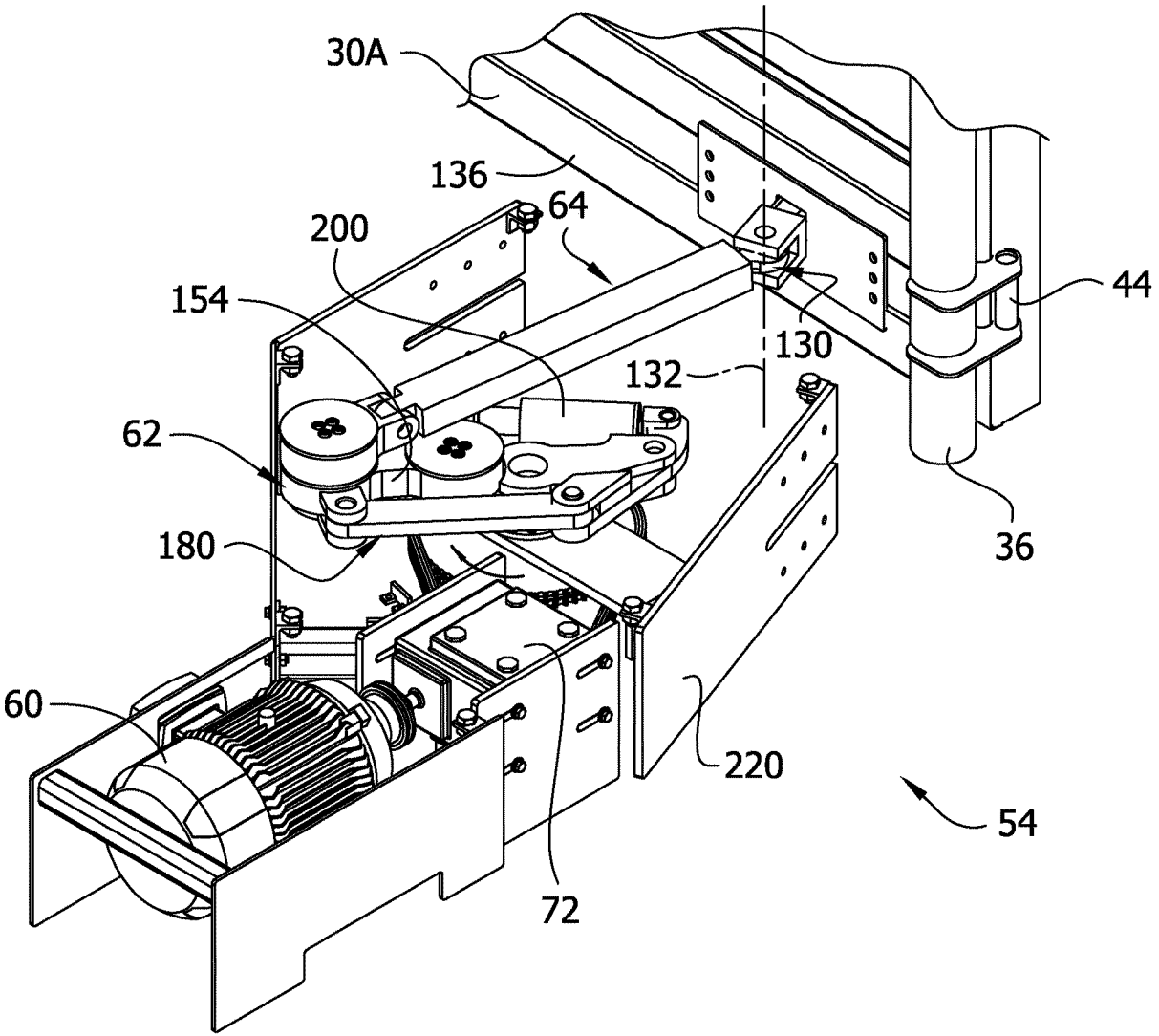
FIG. 12 is fragmentary bottom perspective of the door-moving mechanism showing the door leaf as the door-moving mechanism is opening the door leaf.
Figure 13:
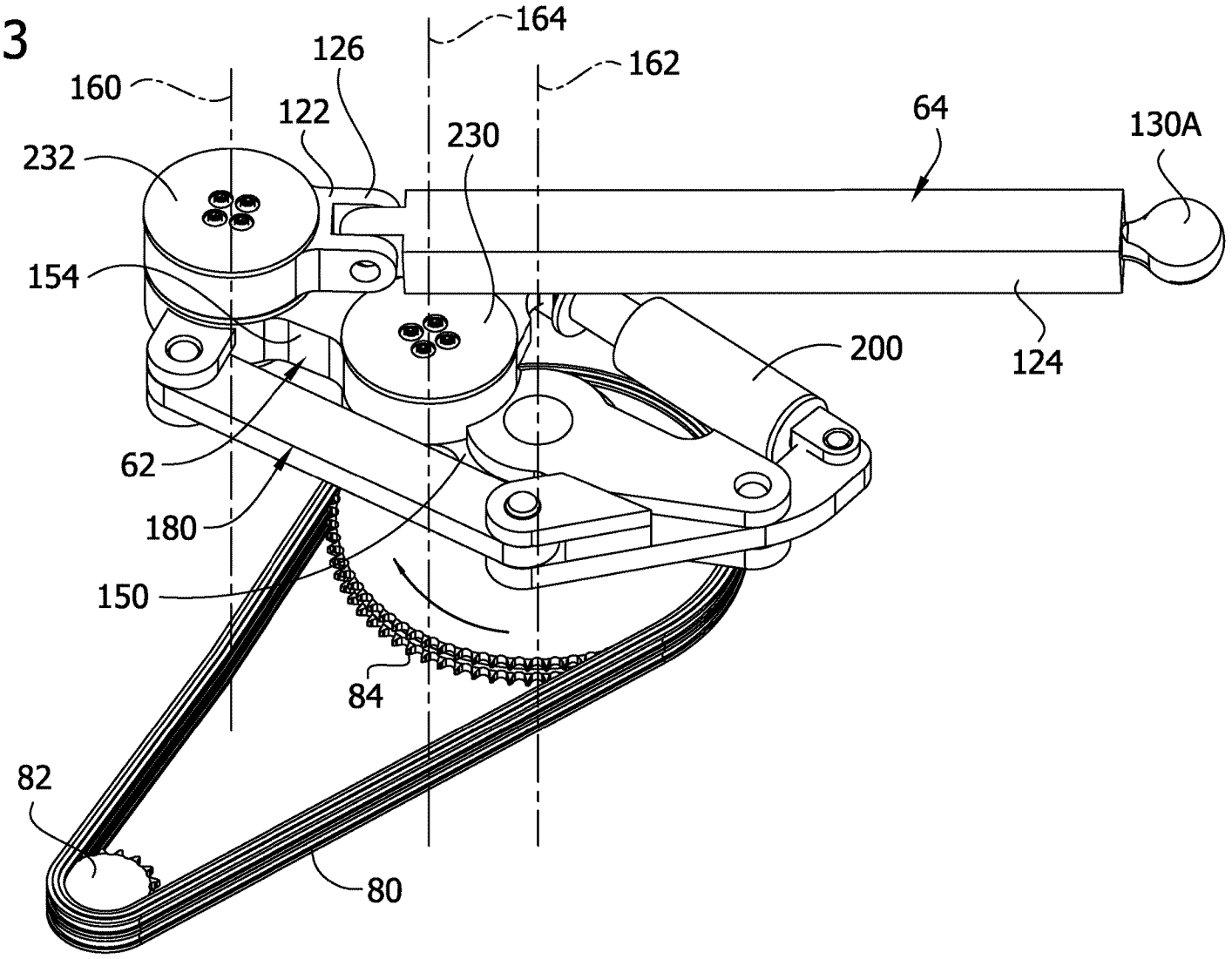
FIG. 13 is an enlarged bottom perspective of the crank as illustrated in FIG. 12.

FIGS. 12 and 13 show one possible configuration of the door-moving mechanism after the motor 60 has been actuated to rotate drive rotation of the door leaf 30A a short distance toward the open position. In some cases, an air-pressure differential across the door 30 exerts a strong static force resisting movement of the door leaf 30A away from its fully-closed position. This force may be strong enough to force the crank 62 into its shorter configuration to automatically generate more door-moving force to overcome the air pressure. Additional details about using the variable-length crank 62 to help the door-moving mechanism 54 overcome an initial air pressure load are set forth in U.S. Pat. No. 8,800,204, the contents of which are hereby incorporated by reference. However, in the sequence illustrated in the drawings, the crank 62 has remained in its longer configuration because the air pressure was not strong enough to require the crank to convert to its shorter configuration. It will be observed that the elongate link 64 remains generally perpendicular to the plane of the door leaf 30A during this segment of movement for maximum efficiency. Also, the crank action causes the speed at which the door leaf 30A moves to increase smoothly from zero as it moves away from its fully-closed position.

FIGS. 14 and 15 show the configuration of the door-moving mechanism after the motor 60 has driven the door leaf 30A to its fully open position in which the crank 62 is again in a dead-center position. Even if there is resistance pressure against the door leaf 30 during initial opening that causes the crank 62 to convert to its shorter configuration, the air pressure typically reduces substantially, i.e., to less than the amount required to deflect the spring 202, before the door leaf 30A arrives at its fully open position. As a result, the crank 62 either remains in its full-throw configuration throughout the opening movement or it converts to its shorter-throw configuration when the door leaf 30A is initially opened and returns to its full-throw configuration before the door leaf is fully opened. The crank action causes the speed at which the door leaf 30A moves to decrease smoothly down to zero as it approaches its fully-open position.

To move the door leaf from its fully-open position (FIG. 14) back to its fully-closed position (FIG. 10), the motor 60 is operated to rotate the sprocket 82 and crank 62 in the same direction about the third axis 162 through an initial-closing movement (FIGS. 16 and 17). The crank action causes the speed at which the door leaf 30A moves to increase smoothly from zero to a maximum speed as it moves away from its fully-open position and then to decrease smoothly to zero as it reaches its fully-closed position. During closing movement, the crank 62 may stay in its second (full-throw) configuration since less power may be needed to close the door.

However, in the sequence illustrated in the drawings, the crank 62 converts to its shorter throw configuration during the initial closing movement. Although the air pressure is generally not a significant factor when the door leaf 30A begins to close, the door leaf 30A can be very heavy in which case the door-moving mechanism has to overcome a lot of inertia to initiate the closing movement. Thus, in some cases the crank 62 will convert to its shorter throw configuration during the initial closing movement to overcome the inertial forces of the door leaf 30A, as illustrated in FIGS. 16 and 17. When this happens, the inertial forces 30A of the door leaf compress the spring 202 in the variable-length linkage member 200 and thereby reconfigure the crank 62 to its shorter-throw configuration.

The inertial forces of the door leaf 30A may also cause the elongate link 64 to pull the drawbar 138 from its retracted position (FIG. 8) toward its extended position (FIG. 9) against the bias of the drawbar biasing spring 140 as the mechanism 54 begins to close the door leaf. The present inventors have recognized that there is potential for a resonant dynamic interaction between the drawbar biasing spring 140 and the spring 202 that biases the crank toward its longer-throw configuration. For example, if this possibility is not considered in the design of the door-moving mechanism 54 it is possible that dynamic interactions between the springs 140, 202 may result in abrupt changes in the forces acting on the door-moving mechanism. In some cases, the door leaf 30A may lag behind the door-moving mechanism 54 due to deformation of the springs 140, 202 and then later the door leaf may be accelerated so much that it slams into the elongate link 64 and transmits a large shock through the components of the door-opening mechanism. In the case of a very large, heavy door leaf 30A, this type of shock has the potential to cause serious damage to the door-opening mechanism 54.

The door-moving mechanism 54 disclosed herein includes several features that limit the potential for such damage from over acceleration of the door leaf 30A. For example, the mechanism is designed so the amount of damping of the crank arm biasing member 202 and the amount of damping of the drawbar biasing member 140 are selected to substantially prevent resonant dynamic interactions between the drawbar biasing member and the crank arm biasing member. In this regard, the use of Belleville springs as the biasing members 140, 202 is advantageous. If one compares a conventional helical coil spring to a Belleville spring in either series or parallel configuration, one can readily see that the coil spring has virtually no internal friction and therefore no ability to dampen its own inertial movement or that of other components with which it has inertial interaction. On the other hand, a Belleville spring in the series configuration will have much less tendency to oscillate for at least three reasons. First, for a given resistance spring, the Belleville spring will have considerably less mass. Therefore, all inertial forces are reduced. Second, the Belleville spring can expand only to the extent of the individual washers. As soon as the washers separate, further expansion stops. Because Belleville springs can be used at relatively high loading with little preload distance, this is a considerable factor. Third, a spring washer of a Belleville spring has a friction engagement with an adjacent washer of the spring set. In a series configuration, this friction results from the action of the small diameter of the washer touching the adjacent washer. In a parallel configuration the friction is much greater as the whole face of the washer is in engagement with the adjacent washer. Series and parallel arrangements can be utilized to create dampening values between the two. Those skilled in the art will understand how to arrange the washers of the Belleville springs 140, 202 in a manner that avoids resonant dynamic interactions.

It is understood that types of springs other than Belleville springs can be used in a manner that avoids resonant dynamic interactions without departing from the scope of the invention. Avoiding resonant dynamic interactions between the springs 140, 202 helps limit the possibility that the door leaf 30A will over-accelerate during closing.

However, it is still possible that there may be some instances in which the door leaf 30A over-accelerates during closing to some extent. The ratcheting tensioner 90 helps ensure there is proper tension in the chain 80. One of the things that can happen if the door leaf 30A over-accelerates is the normally tensioned side of the chain can abruptly go slack as the door leaf slams into the components of the door-moving mechanism 54. Because the ratcheting tensioner 90 automatically takes up excess slack as the chain 80 wears, the door-moving mechanism 54 is more resistant to over-acceleration of the door leaf 30A causing the chain to walk off the sprockets 82, 84. The use of a double row chain 80 also helps prevent the chain from walking off the sprockets 82, 84 because the chain does not sag as much under slack conditions and also because double row chains are more resistant to walking off sprockets in general.

The elongate link 64 is also designed to limit the amount of torque that can be transmitted from the door leaf 30A through the elongate link to the other components of the door-moving mechanism 54. For example, the ball joint 130 provides additional degrees of freedom in the relative movement between the elongate link 64 and the door leaf 30A. Also, the lever formed by the first rigid member 122 is relatively short. Some of the forces applied to the elongate link 64 at the ball joint 130 will result in bending at the pivot connection 126 which substantially prevents these forces from transmitting undesirable torque to the bearings 170, 172, 194 having a vector that is perpendicular to their axes 160, 162, 164. Thus, the location of the pivot connection 126 between the two rigid members 122, 124 of the elongate link 64 allows vertical movement between the door leaf 30A and the crank 62 (e.g., to compensate for changing differences in elevation between the door leaf and the crank as the door opens and closes) while protecting the bearings 170, 172, 194 against binding action and/or damage.

Referring again to the sequence illustrated in FIGS. 10-17, the variable-throw crank 62 is configured to pivot in one direction through an angle of about 360 degrees as the door leaf moves from its fully-closed position to its fully-open position and then back to its fully-closed position. In other embodiments, a reversing motor (or other reversing drive) is used to rotate the crank (e.g., 180 degrees) in one direction to open the door leaf and in the opposite or reverse direction (e.g., 180 degrees) to close it.

The operation of the second door-moving mechanism 56 to open and close the second door leaf 30B is suitably substantially similar to the operation of the first door-moving mechanism 54 described above. As noted previously, the opening and closing of the door leafs 30A, 30B are preferably sequenced such that the door leaf 30A with the astragal seal 50 starts its initial movement at least slightly before the initial opening movement of the other door leaf 30B to avoid damage to the seal, and such that the door leaf 30A with the astragal seal arrives back at its fully-closed position at least slightly after the other door leaf 30B has reached its fully-closed position to insure proper sealing.

The control system 250 controls the operation of the motors 60 of both door-moving mechanisms 54, 56, preferably independent of one another. As a result, the control system 250 is able to control the movement of each door leaf independent of the other door leaf to achieve the desired opening and closing times of each door leaf, the sequence of movement of one door leaf relative to the other door leaf, and any other variations in movement that may be desirable.

By way of example but not limitation, the control system 250 may be programmed to operate the door opening mechanism 54 to rotate the crank 62 through a 180 degree turn in a nominal time of about seven seconds. In this example, the mechanism 54 may be configured as follows: the motor 60 (e.g., a 6-pole motor) operates at a motor speed of 1200 RPM; the speed reducer 72 has a reduction ratio of 60:1 and an output speed of 20 RPM; and the endless belt 80 (e.g., chain) has a 4.375:1 speed reduction ratio, thus providing a crank 62 RPM of about 4.57, or about 13.13 seconds per revolution, or about 6.5 seconds per half revolution (180 degrees). The crank speed is 4.57 RPM, but the actual operating speed of the door leaf 30A, 30B will vary as it takes more than 180 degrees to open it and less than 180 degrees to close it. This is advantageous because it gives the connecting link 64 a better vector as the door opens by swinging the crank 62 toward the center of the door and creating a more perpendicular vector during opening, and a better vector as the door closes by swinging the crank away from the center of the door and giving a more acute vector during closing. Hence it is a more direct thrust against the door in opening, which is slower and is more efficient. Upon closing the reverse is true. The vector advantage is traded for speed—advantageous as the load is lower in closing. In this example, the opening speed is about eight seconds, and the closing speed is about six seconds.

As previously noted, in the illustrated embodiment the door-moving mechanisms 54, 56 are substantially identical. However, in other embodiments, the second door-moving mechanism 56 may differ from the first mechanism 54. By way of example, the first door-moving mechanism 54 may include a variable-length crank mechanism, as described above, and the second door-moving mechanism may not include a variable-length crank mechanism or may include a different variable-length crank mechanism. For instance, the first mechanism could be optimized to open the first door leaf 30A first to relieve an air load on the door and also to address the possibility of over-acceleration of the door leaf during closing, and the second mechanism may be optimized in a different way to address only the possibility of over-acceleration of the door leaf during closing since the air load may not be as much of a factor for the second door leaf 30B to be opened.

Having described the invention in detail, it will be apparent that modifications and variations are possible without departing from the scope of the invention defined in the appended claims.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above constructions, products, and methods without departing from the scope of the invention, it is intended that all matter contained in the above description and shown in the accompanying drawings shall be interpreted as illustrative and not in a limiting sense.

What is claimed is:

1. A mine door system comprising:

a mine door comprising a door leaf adapted to be hinged at one side to a door frame defining an entry; and an articulated door-moving mechanism that articulates between a first configuration in which the mechanism applies a first door-moving force to the door leaf and moves the door leaf at a first speed and a second configuration in which the mechanism applies a second door-moving force to the door leaf that is greater than the first door-moving force and moves the door leaf at a second speed less than the first speed, wherein the articulated door moving mechanism comprises:

a motor for driving pivoting movement of the door leaf;

a variable length crank drivingly connected to the motor so the motor can drive rotation of the variable length crank, the variable length crank having a first length when the articulated door-moving mechanism is in the first configuration and a second length different from said first length when the articulated door-moving mechanism is in the second configuration;

an elongate compound link having a longitudinal axis, the compound link comprising first and second rigid members secured together at a pivot connection for pivoting movement relative to one another about a pivot axis that is transverse to said longitudinal axis, the variable length crank being connected to the elongate compound link at a location on the first rigid member spaced from said pivot connection, the door leaf being connected to the second rigid member at an end of the second rigid member opposite the pivot connection, the first rigid member being shorter than the second rigid member.

2. A mine door system as set forth in claim 1 wherein the pivot axis is a first pivot axis, the second rigid member is connected to the door leaf for rotation about an axis of rotation between the second rigid member and the door leaf, and the first rigid member is connected to variable length crank for rotation about a second pivot axis, and wherein a ratio of the length of the distance between the axis of rotation and the first pivot axis to the length of the distance between the first and second pivot axes is at least 5 to 1.

3. A mine door system as set forth in claim 2 wherein said ratio is at least about 8 to 1.

4. A mine door system as set forth in claim 1 wherein the variable length crank comprises at least one bearing having bearing axis that is substantially parallel to a hinge axis of the door leaf, the pivot axis of the elongate compound link being substantially orthogonal to the hinge axis and substantially orthogonal to the bearing axis.

5. A mine door system as set forth in claim 4 wherein the elongate compound link substantially prevents transmission of torque associated with vertical reaction forces that may be applied to the second rigid member by the door leaf through the elongate compound link to the bearing.

6. A mine door system as set forth in claim 1 wherein the variable length crank is configured to rotate in a single direction and thereby drive movement of the door leaf from a fully closed position to a fully open position and then back to the fully closed position.

7. A mine door system as set forth in claim 6 wherein the motor is a non-reversing motor.

8. A mine door system as set forth in claim 1 wherein the second rigid member is connected to the door leaf by a joint selected from the group consisting of a ball joint, a clevis connection, and a universal joint.

9. A mine door system as set forth in claim 1 wherein the door leaf comprises a panel and a draw bar extending from the panel, the second rigid member being connected to the draw bar adjacent an end of the draw bar opposite the panel.

10. A mine door system as set forth in claim 9 wherein the second rigid member is connected to the draw bar by a joint selected from the group consisting of a ball joint, a clevis connection, and a universal joint.

11. A mine door system as set forth in claim 9 wherein the door leaf is adapted to allow the draw bar to move relative to the panel from a retracted position to an extended position, the door leaf further comprising a draw bar biasing member arranged to bias the draw bar toward the retracted position.

12. A mine door system as set forth in claim 11 wherein the draw bar biasing member comprises a Belleville spring.

13. A mine door system as set forth in claim 11 wherein the variable length crank comprises first and second crank arms connected to one another for pivoting movement relative to one another to change the length of the crank between the first and second lengths, the system further comprising a crank arm biasing member arranged to bias the first and second crank arms toward a configuration in which the variable length crank has a first length and to allow movement of the first and second crank arms against the bias to a configuration in which the variable length crank has a second length that is shorter than the first length.

14. A mine door system as set forth in claim 13 wherein the system is designed so damping of the draw bar biasing member and damping of the crank arm biasing member substantially prevent any resonant dynamic interactions between the drawbar biasing member and the crank arm biasing member.

15. A mine door system as set forth in claim 14 wherein at least one of the draw bar biasing member and the crank arm biasing member comprises a stack of spring washers arranged to form a Belleville spring in which friction between the washers provides sufficient damping to substantially prevent said resonant dynamic interactions.

16. A mine door system as set forth in claim 1 wherein the articulated door-moving mechanism further comprises a sprocket connected to the variable length crank and a chain in mesh with the sprocket and arranged to transmit power from the motor to the variable length crank through the chain and sprocket, the system further comprising a ratcheting tensioner positioned to reduce a slack in the chain.

17. A mine door system as set forth in claim 16 wherein the ratcheting tensioner comprises an arm, an idler sprocket secured to the arm and in mesh with the chain, and a ratcheting mechanism comprising a spring, a plurality of teeth on the arm, and a pawl, wherein the spring, teeth, and pawl are arranged so the spring automatically slides one or more of the teeth past the pawl and extends the arm toward the chain as the chain lengthens due to wear, and wherein the pawl engages the teeth to limit retraction of the arm away from the chain.

18. A mine door system as set forth in claim 17 wherein the chain comprises a double row chain for limiting sag in the chain.

19. A mine door system comprising:

a mine door comprising a door leaf adapted to be hinged at one side to a door frame defining an entry, the door leaf comprising a panel, a draw bar extending from the panel and adapted to move from a retracted position to an extended position relative to the panel, and a biasing member arranged to bias the draw bar toward the retracted position; and an articulated door-moving mechanism that articulates between a first configuration in which the mechanism applies a first door-moving force to the door leaf and moves the door leaf at a first speed and a second configuration in which the mechanism applies a second door-moving force to the door leaf that is greater than the first door-moving force and moves the door leaf at a second speed less than the first speed, wherein the articulated door moving mechanism comprises:

a motor for driving pivoting movement of the door leaf;

a variable length crank drivingly connected to the motor so the motor can drive rotation of the variable length crank, the variable length crank comprising first and second crank arms connected to one another for pivoting movement relative to one another to change the length of the crank between a first length and a second length that is shorter than the first length, and a crank arm biasing member arranged to bias the first and second crank arms toward a configuration in which the variable length crank has the first length and to allow movement of the first and second crank arms against the bias to a configuration in which the variable length crank has the second length; and an elongate link, the variable length crank being connected to the elongate link at one end of the crank and the draw bar of the door leaf being connected to the elongate link at an opposite end of the elongate link, wherein the system is designed so damping of the draw bar biasing member and damping of the crank arm biasing member substantially prevent any resonant dynamic interactions between the drawbar biasing member and the crank arm biasing member.

20. A mine door system as set forth in claim 19 wherein the draw bar biasing member and the crank arm biasing member each comprise a stack of spring washers arranged to form a Belleville spring.

21. A mine door system as set forth in claim 20 wherein the Belleville springs are designed so friction between the washers provides sufficient damping to substantially prevent said resonant dynamic interactions.

22. A mine door system as set forth in claim 19 wherein the elongate link comprises a compound elongate link, the compound elongate link comprising first and second rigid members connected to one another at a pivot connection between the variable length crank and the door leaf.

23. A mine door system as set forth in claim 19 wherein the variable length crank is configured to rotate in a single direction and thereby drive movement of the door leaf from a fully closed position to a fully open position and then back to the fully closed position.

24. A mine door system as set forth in claim 23 wherein the motor is a non-reversing motor.

25. A mine door system as set forth in claim 19 wherein the elongate link is connected to the draw bar of the door leaf by a joint selected from the group consisting of a ball joint, a clevis connection, and a universal joint.

26. A mine door system as set forth in claim 19 wherein the articulated door-moving mechanism further comprises a sprocket connected to the variable length crank and a chain in mesh with the sprocket and arranged to transmit power from the motor to the variable length crank through the chain and sprocket, the system further comprising a ratcheting tensioner positioned to limit slack in the chain.

27. A mine door system as set forth in claim 26 wherein the ratcheting tensioner comprises an arm, an idler sprocket secured to the arm and in mesh with the chain, and a ratcheting mechanism comprising a plurality of teeth, and a pawl, wherein the spring, teeth, and pawl are arranged so the spring automatically slides one or more of the teeth past the pawl and extends the arm toward the chain as the chain lengthens due to wear by and wherein the pawl engages the teeth to limit retraction of the arm away from the chain.

28. A mine door system as set forth in claim 27 wherein the chain comprises a double row chain for limiting sag in the chain.

29. A mine door system comprising:

a mine door comprising a door leaf adapted to be hinged at one side to a door frame defining an entry, the door leaf comprising a panel, a draw bar extending from the panel and adapted to move from a retracted position to an extended position relative to the panel, and a biasing member arranged to bias the draw bar toward the retracted position; and an articulated door-moving mechanism that articulates between a first configuration in which the mechanism applies a first door-moving force to the door leaf and moves the door leaf at a first speed and a second configuration in which the mechanism applies a second door-moving force to the door leaf that is greater than the first door-moving force and moves the door leaf at a second speed less than the first speed, wherein the articulated door moving mechanism comprises:

a motor for driving pivoting movement of said door leaf;

a variable length crank drivingly connected to the motor so the motor can drive rotation of the variable length crank, the variable length crank comprising first and second crank arms connected to one another for pivoting movement relative to one another to change the length of the crank between a first length and a second length that is shorter than the first length, and a crank arm biasing member arranged to bias the first and second crank arms toward a configuration in which the variable length crank has the first length and to allow movement of the first and second crank arms against the bias to a configuration in which the variable length crank has the second length; and an elongate link, the variable length crank being connected to the elongate link at one end of the elongate link, and the draw bar of the door leaf being connected to the elongate link at an opposite end of the elongate link, wherein at least one of the draw bar biasing member and the crank arm biasing member comprises a series of washers arranged to form a Bellville spring.

30. A mine door system comprising:

a mine door comprising a door leaf adapted to be hinged at one side to a door frame defining an entry; and an articulated door-moving mechanism that articulates between a first configuration in which the mechanism applies a first door-moving force to the door leaf and moves the door leaf at a first speed and a second configuration in which the mechanism applies a second door-moving force to the door leaf that is greater than the first door-moving force and moves the door leaf at a second speed less than the first speed, wherein the articulated door moving mechanism comprises:

a motor for driving pivoting movement of the door leaf;

a variable length crank drivingly connected to the motor so the motor can drive rotation of the variable length crank, the variable length crank having a first length when the articulated door-moving mechanism is in the first configuration and a second length different from said first length when the articulated door-moving mechanism is in the second configuration;

a link connecting the variable length crank to the door leaf;

wherein the door leaf comprises a panel and a draw bar extending from the panel, the link being connected to the draw bar adjacent an end of the draw bar opposite the panel;

wherein the door leaf is adapted to allow the draw bar to move relative to the panel from a retracted position to an extended position, the door leaf further comprising a draw bar biasing member arranged to bias the draw bar toward the retracted position.

* * * * *